US007583025B2

(12) United States Patent
Woo et al.

(10) Patent No.: US 7,583,025 B2
(45) Date of Patent: Sep. 1, 2009

(54) PLASMA DISPLAY MODULE AND METHOD OF MANUFACTURING THE SAME

(75) Inventors: Seok-Gyun Woo, Suwon-si (KR); Kyoung-Doo Kang, Suwon-si (KR); Chong-Gi Hong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 607 days.

(21) Appl. No.: 11/133,264

(22) Filed: May 20, 2005

(65) Prior Publication Data

US 2005/0264198 A1 Dec. 1, 2005

(30) Foreign Application Priority Data

May 27, 2004 (KR) ..... 10-2004-0037671

(51) Int. Cl.
*H01J 17/49* (2006.01)

(52) U.S. Cl. ..... 313/582; 313/11; 313/46

(58) Field of Classification Search ..... 313/582–587, 313/11, 46; 361/681, 686, 704
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph L Williams
*Assistant Examiner*—Kevin Quarterman
(74) *Attorney, Agent, or Firm*—Robert E. Bushnell, Esq.

(57) ABSTRACT

A plasma display module that can improve the emission efficiency of light, generate a discharge quickly, reduce an address voltage, and be manufactured at lower costs and failure rates, includes a substrate formed of a transparent insulator, a chassis base disposed on a rear side of the substrate, a plurality of barrier ribs formed of a dielectric disposed between the substrate and the chassis base and define discharge cells together with the substrate and the chassis base, a plurality of front discharge electrodes formed in the barrier ribs that surround the discharge cell, a plurality of rear discharge electrodes spaced apart from the front discharge electrodes and formed in the barrier ribs to surround the discharge cell, a fluorescent layer disposed in the discharge cell, a discharge gas filled in the discharge cell, and a plurality of circuit substrates that apply electrical signals to the electrodes by disposing on a rear side of the chassis base.

31 Claims, 22 Drawing Sheets

U.S. PATENT DOCUMENTS

| | | | | |
|---|---|---|---|---|
| 5,786,794 | A | 7/1998 | Kishi et al. | |
| 5,952,782 | A | 9/1999 | Nanto | |
| RE37,444 | E | 11/2001 | Kanazawa | |
| 6,501,221 | B1 * | 12/2002 | Kim et al. | 313/583 |
| 6,630,916 | B1 | 10/2003 | Shinoda | |
| 6,707,436 | B2 | 3/2004 | Setoguchi et al. | |
| 2002/0135545 | A1 * | 9/2002 | Akiba | 345/60 |
| 2005/0212424 | A1 * | 9/2005 | Kwon et al. | 313/582 |
| 2005/0231109 | A1 * | 10/2005 | Yoo | 313/582 |

FOREIGN PATENT DOCUMENTS

| | | |
|---|---|---|
| JP | 10-172442 | 6/1998 |
| JP | 2845183 | 10/1998 |
| JP | 2917279 | 4/1999 |
| JP | 2001-043804 | 2/2001 |
| JP | 2001-325888 | 11/2001 |

* cited by examiner

PLASMA DISPLAY MODULE AND METHOD OF MANUFACTURING THE SAME

CLAIM OF PRIORITY

This application makes reference to, incorporates the same herein, and claims all benefits accruing under 35 U.S.C. §119 from an application for PLASMA DISPLAY MODULE AND METHOD FOR MANUFACTURING THE SAME earlier filed in the Korean Intellectual Property Office on 27 May 2004 and there duly assigned Ser. No. 10-2004-0037671.

BACKGROUND OF THE INVENTION

1. Field of the Invention

The present invention relates to a plasma display module.

2. Description of the Related Art

A plasma display module is a display device on which a predetermined image is displayed using light emitted from fluorescent materials excited by ultraviolet rays generated by a gas discharge. It is expected to be a next generation display device since a thin and wide displaying surface can be produced.

FIG. 1 is a perspective view of a conventional plasma display module. The plasma display module includes a PDP (plasma display panel) 1 that includes a front panel 10 and a rear panel 20, a chassis base 40 that supports the PDP 1, and a plurality of circuit substrates 61, 62, 63, 64, 65, and 66 that drive the PDP 1 and are disposed on a rear side of the chassis base 40. The circuit substrates 61, 62, 63, 64, 65, and 66 are connected to one another through a connection cable 55 and to the PDP 1 through connection cables 51, 52, 53, and 54.

The circuit substrate 61 disposed on an upper central part of the chassis base 40 functions to transform a power supplied from the outside to a required form, the circuit substrate 62 disposed on a lower central part of the chassis base 40 functions to transform image signals received from the outside to meet the driving method of the PDP 1, the circuit substrate 63 disposed on a left side of the chassis base 40 functions to apply a discharge pulse to a Y electrode 13 which will be described later, the circuit substrate 64 disposed on a right side of the chassis base 40 functions to apply a discharge pulse to an X electrode 12 which will also be described later, and the circuit substrates 65 and 66 disposed on uppermost and lowermost sections of the chassis base 40 function to apply a discharge pulse to address electrodes 22 which will be described later.

The PDP 1 depicted in FIG. 1 is a dual address driving PDP in which the address electrodes are divided on uppermost and lowermost sections of the chassis base 40. Therefore, two circuit substrates for applying an address signal to the address electrodes 22 are required. However, in a PDP in which the address electrodes are not divided, one of the above circuit substrates 65 and 66 is required.

A vent hole P is used for removing impure gases and filling a discharge gas after sealing the front panel 10 and the rear panel 20 in a manufacturing process of the PDP 1, and when the removal of the impure gasses and the filling of the discharge gas is completed, an end of the vent hole is sealed.

The PDP 1 includes a display region AD on which images are displayed and disposed on an overlapping region of the front panel 10 and the rear panel 20 and a sealing region AS on which a sealing member, such as frit for bonding the front panel 10 and the rear panel 20, is coated surrounding the display region AD.

The front panel 10 includes a first connection unit AC1 disposed on a left side of the sealing region AS and connected to the connection cable 53 and a second connection unit AC2 to which the connection cable 54 is attached and disposed on a right side of the sealing region AS. The rear panel 20 includes a third connection unit AC3 to which the connection cable 51 is attached and disposed an upper edge of the sealing region AS and a fourth connection unit AC4 to which the connection cable 52 is attached and disposed on a lower edge of the sealing region AS.

FIG. 2 is a cutaway exploded perspective view of a conventional plasma display module in which a structure of the display region AD is shown. The PDP 1 depicted in FIG. 2 is similar to the PDP disclosed in Japanese Patent Laid-Open Publication No. 1998-172442 for *Plasma Display and Manufacture Thereof* by Iguchi et al.

The PDP 1 includes a rear substrate 21, a plurality of address electrodes 22 disposed parallel to each other on the entire surface of the rear substrate 21, a rear dielectric layer 23 that covers the address electrodes 22, a plurality of barrier ribs 24 formed on the rear dielectric layer 23, a fluorescent layer 25 formed on side surfaces of the barrier ribs 24 and on the entire surface of the rear dielectric layer 23, a front substrate 11 disposed parallel to the rear substrate 21, a plurality of sustain discharge electrode pairs 14 disposed on a rear surface of the front substrate 11, a front dielectric layer 15 that covers the sustain discharge electrode pairs 14, and an MgO film 16 that covers the front dielectric layer 15.

The sustain discharge electrode pairs 14 includes an X electrode 12 and a Y electrode 13. The X and Y electrodes 12 and 13 respectively includes transparent electrodes 12*b* and 13*b* and bus electrodes 12*a* and 13*a*. In the above PDP 1, one sub-pixel is defined by one sustain discharge electrode pair 14 and two adjacent barrier ribs 24.

In the above PDP 1, a sub-pixel that will emit light is selected by an address discharge between the address electrode 22 and the Y electrode 13, the selected sub-pixel generates light by a sustain discharge occurred between the X and Y electrodes 12 and 13 of the sub-pixel selected. More specifically, a discharge gas filled in the sub-pixel generates ultraviolet rays by the sustain discharge, and the ultra violet rays excite the fluorescent layer 25 to generate visible light. An image is displayed on the PDP 1 by the light emitted from the fluorescent layer 25.

There are various conditions for increasing the light emitting efficiency of the PDP 110. One of the conditions is that elements that hinder the emission of visible light emitted from the fluorescent layer 25 must be minimized.

However, in the above structure of PDP 1, the visible light that passes through the front substrate 11 is approximately 60% of the light emitted from the fluorescent layers 25 since a portion of the visible light emitted from the fluorescent layer 25 is absorbed or reflected by the MgO film 16, the front dielectric layer 15, the transparent electrodes 12*b* and 13*b*, and the bus electrodes 12*a* and 13*a*.

Also, the generation of an address discharge requires time and the address voltage is high since the distance (150 μm (microns) in a conventional product) between the address electrode 22 and the Y electrode 13 is distant.

To manufacture the conventional PDP 1, the front panel 10 can be manufactured such that sustain discharge electrode pairs 14 are formed on the front substrate 11 and the sustain discharge electrode pairs 14 are covered by the front dielectric layer 15 and the MgO film 16, and the rear panel 20 can be manufactured such that address electrodes 22 are formed on the rear substrate 21, the address electrodes 22 are covered by the rear dielectric layer 23, and the barrier ribs 24 and the fluorescent layer 25 are formed on the rear dielectric layer 23. Afterward, the front panel 10 and the rear panel 20 are air tightly sealed. The manufacturing of the PDP 1 is completed by exhausting impure gases from a space formed between the front panel 10 and the rear panel 20 and filling a discharge gas in the space.

To manufacture the conventional PDP 1, a line of equipment for manufacturing the front panel 10, another line of equipment for manufacturing the rear panel 20, and still another line for exhausting impure gasses and filling a discharge gas are separately required.

Various equipments can lead to product failures while transferring from one process to another or while aligning the front panel 10 and the rear panel 20, and process time is long and a large area, thereby increasing the manufacturing costs.

SUMMARY OF THE INVENTION

It is therefore and object of the present invention to provide a plasma display module that can improve the emission efficiency of light.

It is another object of the present invention to provide a plasma display module that can quickly generate an address discharge and reduce an address voltage.

It is yet another object of the present invention to provide a plasma display module that can reduce failure rate and manufacturing costs.

It is another object of the present invention, to prevent where various equipments can lead to product failures while transferring from one process to another or while aligning the front panel and the rear panel.

It is still another object of the present invention to provide process time that is shorter and in a smaller area, thereby decreasing the manufacturing costs.

According to an aspect of the present invention, there is provided a plasma display module comprising: a substrate formed of a transparent insulator; a chassis base disposed on a rear side of the substrate; a plurality of barrier ribs formed of a dielectric disposed between the substrate and the chassis base and define discharge cells together with the substrate and the chassis base; a plurality of front discharge electrodes formed in the barrier ribs that surround the discharge cell; a plurality of rear discharge electrodes spaced apart from the front discharge electrodes and formed in the barrier ribs to surround the discharge cell; a fluorescent layer disposed in the discharge cell; a discharge gas filled in the discharge cell; and a plurality of circuit substrates that apply electrical signals to the electrodes by disposing on a rear side of the chassis base.

The barrier ribs can be formed on a rear surface of the substrate.

The chassis base can be formed of an insulator. In this case, a front surface of the chassis base can be covered by an MgO film.

The chassis base can be formed of a conductive material and an insulating layer can be formed on a front surface of the chassis base. In this case, the front surface of the insulating layer can be covered by the MgO film.

The fluorescent layer can be formed on a rear surface of the substrate that defines the discharge cell and the thickness of the fluorescent layer may be less than 15 μm.

The chassis base can be formed of an insulator, the barrier ribs can be formed on a front surface of the chassis base, and the fluorescent layer can be formed on a front surface of the chassis base that defines the discharge cell. In this case, the rear surface of the substrate may be covered by the MgO film and the thickness of the fluorescent layer may be less than 15 μm.

The chassis base can be formed of a conductive material, an insulating layer can be formed on a front surface of the chassis base, the barrier ribs can be formed on a front surface of the insulating layer, and the fluorescent layer can be formed on a front surface of the insulating layer in the discharge cell. In this case, the rear surface of the substrate can be covered by the MgO film and the thickness of the fluorescent layer may be less than 15 μm.

The front discharge electrodes and the rear discharge electrodes can be extended in a direction, the chassis base can be formed of an insulator, address electrodes extending to cross the front discharge electrodes and the rear discharge electrodes can be formed on a front surface of the chassis base, the address electrodes can be covered by a dielectric layer, the barrier ribs can be formed on a front surface of the dielectric layer, and the fluorescent layer can be formed on a front surface of the dielectric layer in the discharge cell. In this case, the rear surface of the substrate may be covered by an MgO film and the thickness of the fluorescent layer may be less than 15 μm.

The front discharge electrodes and the rear discharge electrodes can be extended in a direction, the chassis base can be formed of a conductive material, an insulating layer can be formed on a front surface of the chassis base, address electrodes extending to cross the front discharge electrodes and the rear discharge electrodes can be formed on a front surface of the insulating layer, the address electrodes can be covered by a dielectric layer, the barrier ribs can be formed on a front surface of the dielectric layer, and the fluorescent layer can be formed on a front surface of the dielectric layer in the discharge cell. In this case, the rear surface of the substrate may be covered by an MgO film and the thickness of the fluorescent layer may be less than 15 μm.

The front discharge electrodes can be extended in a direction and the rear discharge electrodes can be extended to cross the front discharge electrodes. In this case, the front discharge electrodes and the rear discharge electrodes can both have a trapezoidal shape.

The front discharge electrodes and the rear discharge electrodes can be extended in a direction and the plasma display module can further include address electrodes disposed in the barrier ribs to surround the discharge cell and extended to cross the front discharge electrodes and the rear discharge electrodes. In this case, the front discharge electrodes, the rear discharge electrodes, and the address electrodes may all have a trapezoidal shape.

The address electrodes can be disposed in front or rear of the front discharge electrodes.

The side surface of the barrier ribs may be covered by an MgO film.

According to an aspect of the present invention, there is provided a method of manufacturing a plasma display module comprising: preparing a substrate formed of a transparent insulator and a chassis base formed of an insulator; alternately forming barrier rib layers and electrodes on a rear surface of the substrate; forming a fluorescent layer on a rear surface of the substrate that defines discharge cells partitioned by the barrier ribs formed by the barrier rib layers; and filling a discharge gas in a space formed by coupling the substrate and the chassis base after air tightly sealing the space. In this case, the method can further include the forming of an MgO film on a side surface of the barrier ribs and the forming of an MgO film on a front surface of the chassis base.

According to an aspect of the present invention, there is provided a method of manufacturing a plasma display module comprising: preparing a substrate formed of a transparent insulator and a chassis base formed of a conductive material;

forming an insulating layer on a front surface of the chassis base; alternately forming barrier rib layers and electrodes on a rear surface of the substrate; forming a fluorescent layer on a rear surface of the substrate that defines the discharge cells partitioned by barrier ribs formed by the barrier rib layers; and filling a discharge gas in a space formed by coupling the substrate and the chassis base after sealing the space. In this case, the method can further include the forming of an MgO film on a side surface of the barrier ribs and the forming of an MgO film on a front surface of the insulating layer.

According to an aspect of the present invention, there is provided a method of manufacturing a plasma display module comprising: preparing a substrate formed of a transparent insulator and a chassis base formed of an insulator; alternately forming barrier rib layers and electrodes on a front surface of the chassis base; forming a fluorescent layer on a front surface of the chassis base that defines discharge cells partitioned by barrier ribs formed by the barrier rib layers; and filling a discharge gas in a space formed by coupling the substrate and the chassis base after sealing the space. In this case, the method can further include the forming an MgO film on a side surface of the barrier ribs and the forming of an MgO film on a rear surface of the substrate.

According to an aspect of the present invention, there is provided a method of manufacturing a plasma display module comprising: preparing a substrate formed of a transparent insulator and a chassis base formed of a conductive material; forming an insulating layer on a front surface of the chassis base; alternately forming barrier rib layers and electrodes on a front surface of the insulating layer; forming a fluorescent layer on a front surface of the insulating layer in the discharge cells partitioned by the barrier ribs formed by the barrier rib layers; and filling a discharge gas in a space formed by coupling the substrate and the chassis base after sealing the space. In this case, the method can further include the forming of an MgO film on a side surface of the barrier ribs and the forming of an MgO film on a rear surface of the substrate.

According to an aspect of the present invention, there is provided a method of manufacturing a plasma display module comprising: preparing a substrate formed of a transparent insulator and a chassis base formed of an insulator; forming address electrodes on a front surface of the chassis base; forming a dielectric layer covering the address electrodes; alternately forming barrier rib layers and electrodes on a front surface of the dielectric layer; forming a fluorescent layer on a front surface of the dielectric layer in the discharge cells partitioned by barrier ribs formed by the barrier rib layers; and filling a discharge gas in a space formed by coupling the substrate and the chassis base after sealing the space air tightly. In this case, the method can further include the forming of an MgO film on a side surface of the barrier ribs and the forming of an MgO film on a rear surface of the substrate.

According to an aspect of the present invention, there is provided a method of manufacturing a plasma display module comprising: preparing a substrate formed of a transparent insulator and a chassis base formed of a conductive material; forming an insulating layer on a front surface of the chassis base; forming address electrodes on a front surface of the insulating layer; forming a dielectric layer covering the address electrodes; alternately forming barrier rib layers and electrodes on a front surface of the dielectric layer; forming a fluorescent layer on a front surface of the dielectric layer in the discharge cells partitioned by barrier ribs formed by the barrier rib layers; and filling a discharge gas in a space formed by coupling the substrate and the chassis base after sealing the space. In this case, the method can further include the forming of an MgO film on a side surface of the barrier ribs and the forming of an MgO film on a rear surface of the substrate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
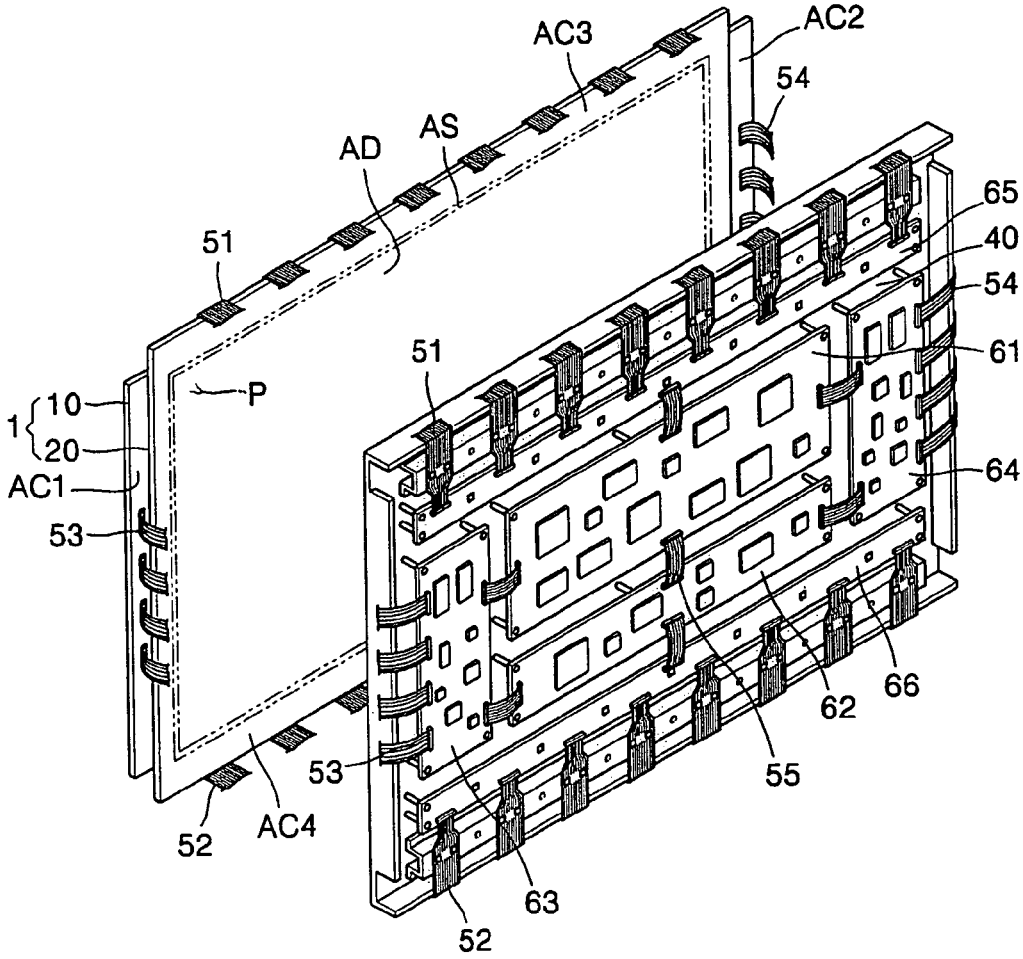
FIG. 1 (CONVENTIONAL ART)
FIG. 1 is an exploded perspective view of a conventional plasma display module.
Figure 2:
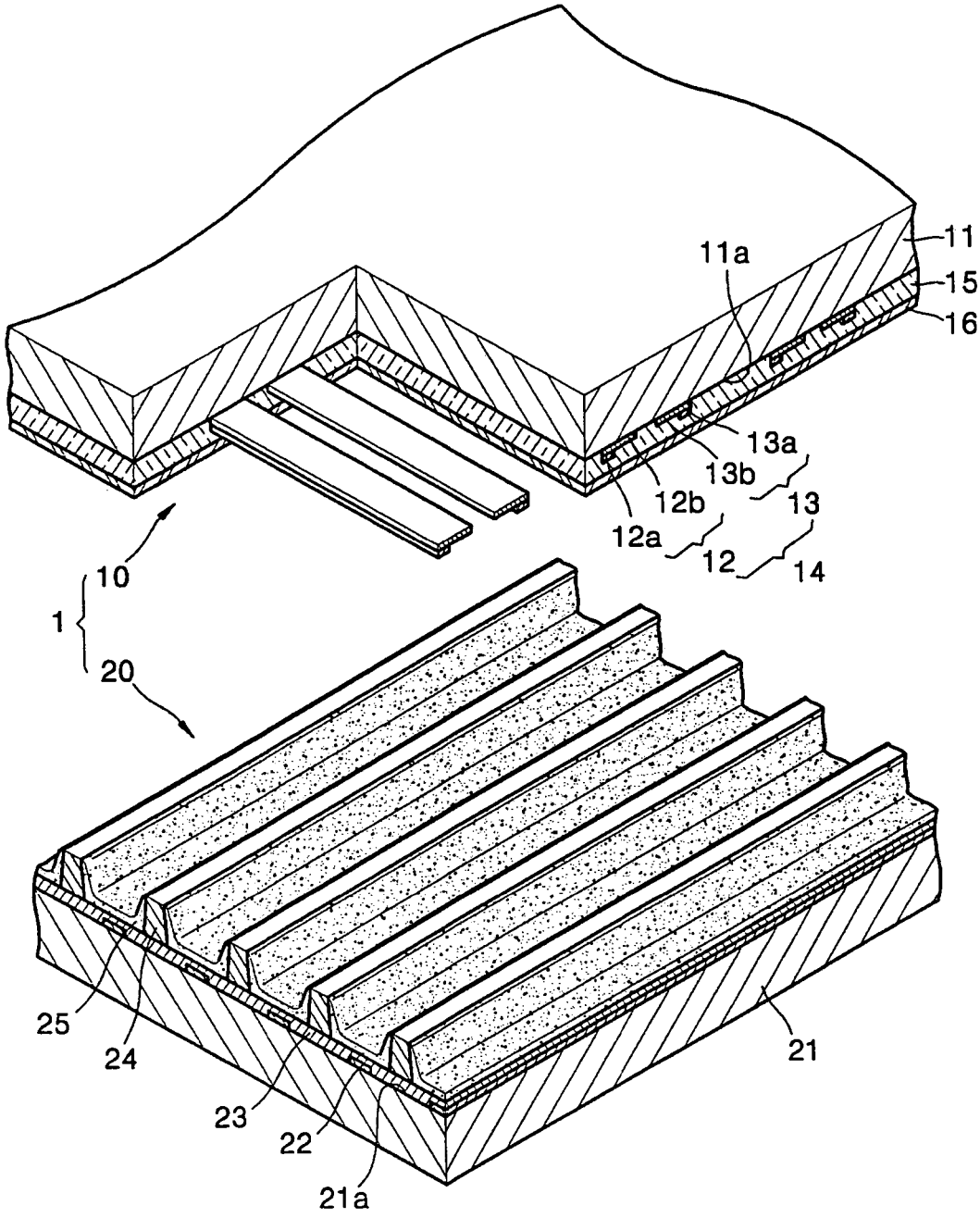
FIG. 2 (CONVENTIONAL ART)
FIG. 2 is a cutaway exploded perspective view of the conventional plasma display module of FIG. 1.

The present invention will now be described more fully with reference to the accompanying drawings in which exemplary embodiments of the invention are shown.

A plasma display module according to a first embodiment of the present invention will now be described with reference to FIGS. 3 through 8.

The plasma display module includes a substrate 111, a chassis base 150, a plurality of barrier ribs 115, an MgO film 116, a plurality of front discharge electrodes 113, a plurality of rear discharge electrodes 112, a plurality of address electrodes 122, a fluorescent layer 125, a discharge gas, and circuit substrates 61, 62, 63, 64, 65, and 66.

The chassis base 150 is formed of an insulator, such as a plastic, and disposed on a rear side of the substrate 111. The insulator can be formed of a material having a resistance to transformation by heat generated by a discharge occurring in a discharge cell 126, which will be described later, and high thermal conductivity. Also, a front surface of the chassis base 150 is preferably flat since it defines discharge cells 126 by coupling with the substrate 111.

The chassis base 150 supports the circuit substrates 61, 62, 63, 64, 65, and 66 disposed on a rear (X direction) of the chassis base 150. Although it is not depicted in the drawing, the front surface 150*a* of the chassis base 150 can be covered by an MgO film (not shown) since the MgO film emits many secondary electrons which facilitate the plasma discharge.

The circuit substrates 61, 62, 63, 64, 65, and 66 apply electrical signals to electrodes 113, 112, and 122 which will be described later. More specifically, the circuit substrate 61 disposed on the central upper side of the chassis base 150 functions to transform a power supplied from the outside to a required form, the circuit substrate 62 disposed on a lower central part of the chassis base 150 functions to transform image signals received from the outside to meet the driving method of the PDP 1, the circuit substrate 63 disposed on a left side of the chassis base 150 functions to apply a discharge pulse to rear discharge electrodes 112 which will be described later, the circuit substrate 64 disposed on a right side of the chassis base 40 functions to apply a discharge pulse to front discharge electrodes 113 which will also be described later, and the circuit substrates 65 and 66 disposed on uppermost and lowermost section of the chassis base 150 function to apply a discharge pulse to address electrodes 122 which will be described later. The circuit substrates 61, 62, 63, 64, 65, and 66 are exemplary and the function of each of the circuit substrates is not determined according to the location of the circuit substrates 61, 62, 63, 64, 65, and 66.

The circuit substrates 61, 62, 63, 64, 65, and 66 are connected to each other through a connection cable 55, the circuit substrates 65 and 66 are connected to end parts 122*a* of the address electrodes 122 respectively by the connection cables 51 and 52, the circuit substrate 63 is connected to end parts 112*a* of the lower discharge electrode by the connection cable 53, and the circuit substrate 64 is connected to end parts 113*a* of the upper discharge electrode by the connection cable 54.

Figure 3:
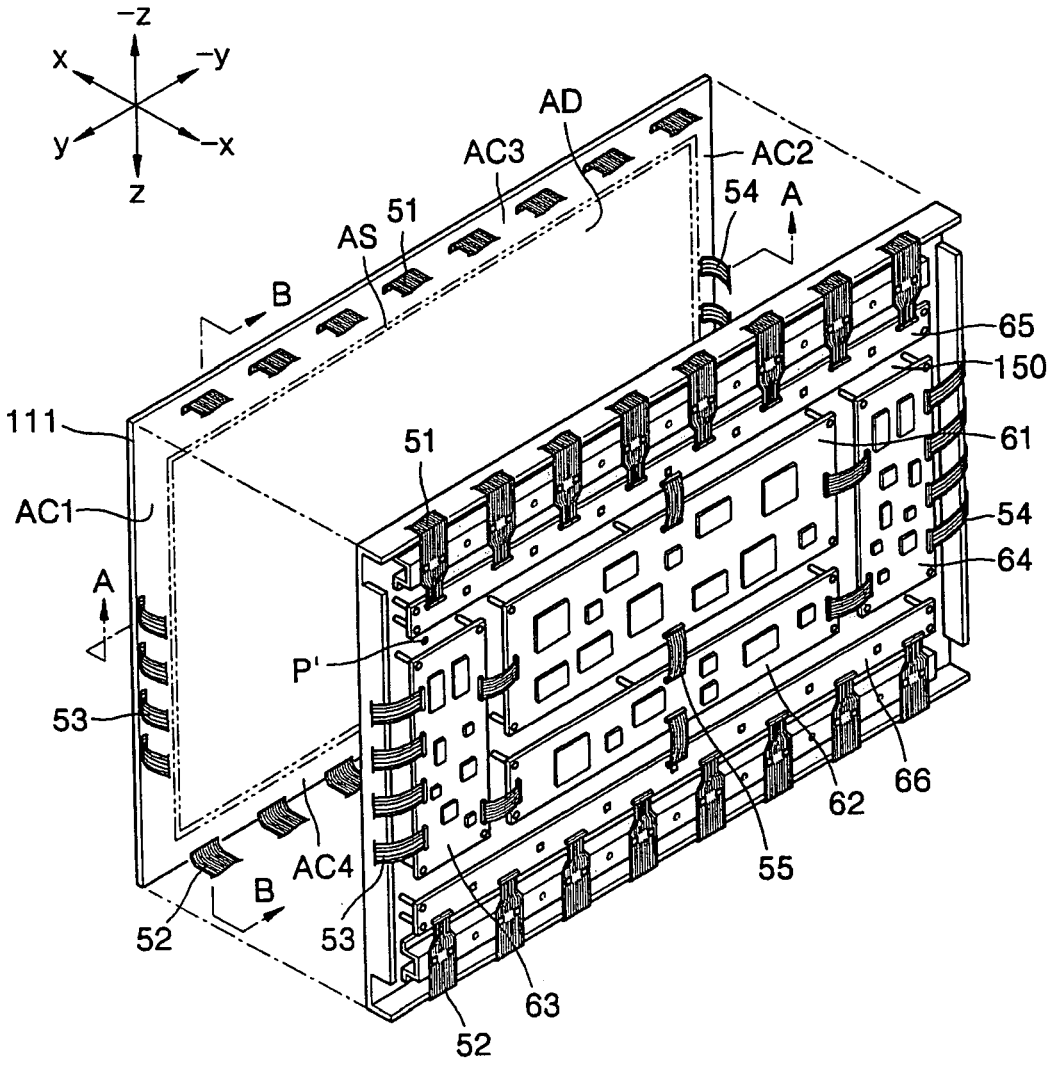
FIG. 3 is an exploded perspective view of a plasma display module according to a first embodiment of the present invention.

The plasma display module 1 depicted in FIG. 3 is a driven by a dual addressing method, in which the address electrodes 122 are divided on uppermost and lowermost sections (−Z direction and Z direction) of the chassis base 150. Therefore, two circuit substrates 65 and 66 for applying an address signal to the address electrodes 122 are required. However, in a plasma display module in which the address electrodes 122 are not divided, one of the above circuit substrates 65 and 66 is required.

The substrate 111 is formed of a transparent insulator such as glass. The substrate 111 includes a display region AD on which an image is displayed, a sealing region AS, on which a sealing member, such as frit that bonds the chassis base 150 and the substrate 111, is coated and surrounds the display region is coated, a first connection unit AC1 to which the connection cable 53 is attached and disposed on a left side of the sealing region AS, a second connection unit AC2 on which the connection cable 54 is attached and disposed on a right side of the sealing region AS, a third connection unit AC3 to which the connection cable 51 is attached and disposed on upper side of the sealing region AS, and a fourth connection unit AC4 to which the connection cable 52 is attached and disposed on a lower side of the sealing region AS.

A plug P' depicted in FIG. 3 is formed for sealing a vent hole formed on the chassis base 150. In a manufacturing process of the plasma display module, after exhausting impure gases and filling a discharge gas in a space formed between the substrate 111 and the chassis base 150, the vent hole is sealed by the plug P'.

The sustain discharge electrode pairs 14 and the front dielectric layer 15 that covers the sustain discharge electrode pairs 14 which are formed on a rear surface 11*a* of the substrate of the conventional PDP 1 are not formed on a portion of the rear surface 111*a* of the substrate 111 that defines the discharge cells 126. Therefore, more than 80% (percent) of visible light emitted from the fluorescent layer 125, which will be described later, passes through the substrate 111, thereby improving the light emission efficiency of the plasma display module.

The barrier ribs 115 are disposed between the substrate 111 and the chassis base 150, more specifically, on a rear surface 111*a* of the substrate 111. The barrier ribs 115 define the discharge cells 126 together with the substrate 111 and the chassis base 150, and are formed of a dielectric.

Figure 4:
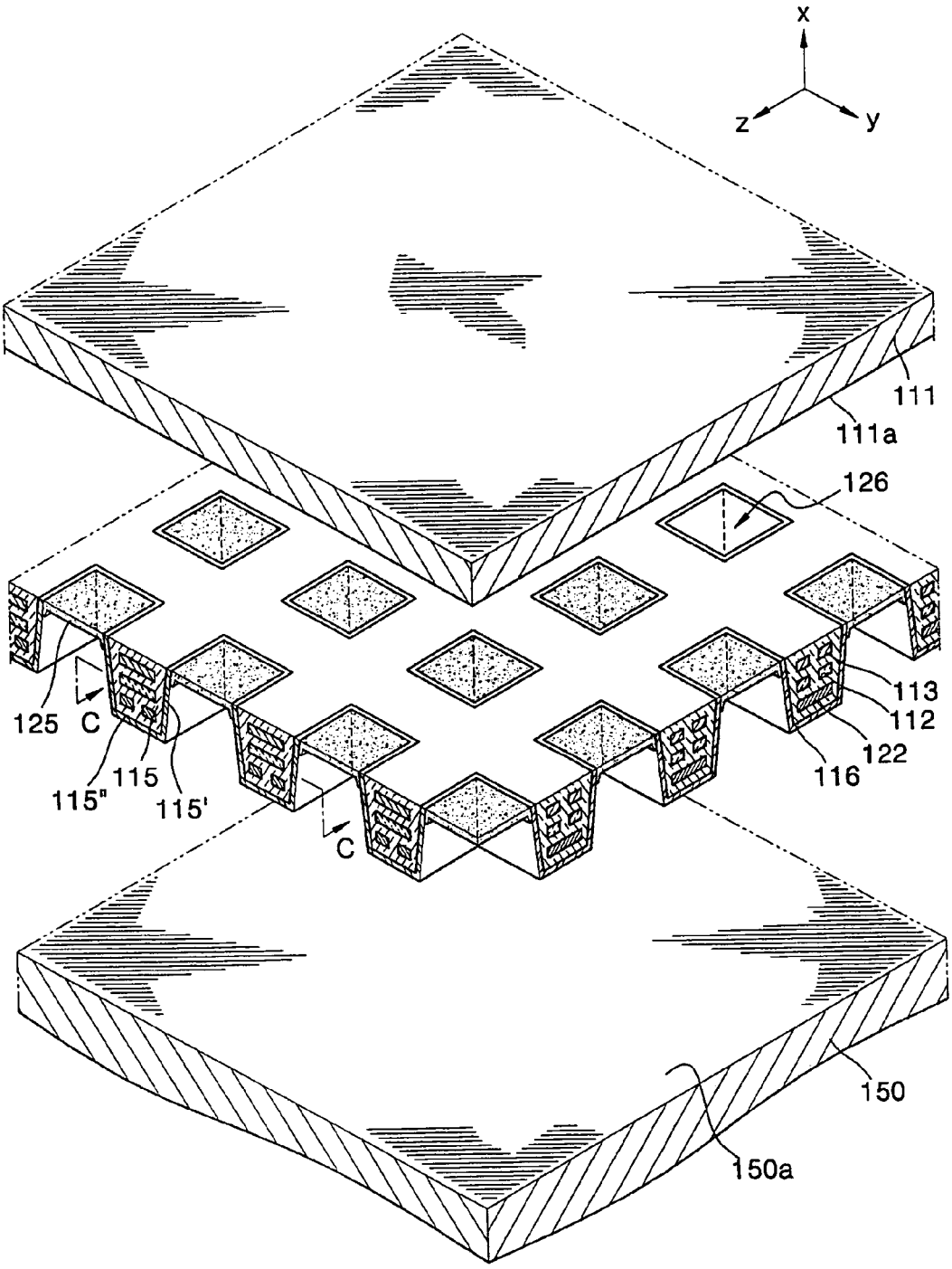
FIG. 4 is a perspective view of a display region of the plasma display module of FIG. 3.

The discharge cells 126 are disposed in a matrix in FIG. 4, but the present invention is not limited thereto, and can be disposed in a delta shape. Also, the shape of the cross-section (cross-section of the y-z plane) of the discharge cell 126 is rectangular, but the present invention is not limited thereto, and can be a polygonal shape, such as a triangle or a pentagon, or an oval or circle.

The barrier ribs 115 are formed of a dielectric that can prevent cross-talk between the rear discharge electrodes 112, the front discharge electrodes 113, and the address electrodes 122 and the damage of the electrodes 112, 113, and 122 by colliding with charged particles. The dielectric can be PbO, $B_2O_3$, or $SiO_2$.

Referring to FIG. 4, at least side surfaces 115' of the barrier ribs 115 can be covered by the MgO film 116. The MgO film 116 can be formed by deposition, and the MgO film 116 can be formed on a rear surface 115" of the barrier ribs 115 and a rear surface 111*a* of the substrate 111 when depositing the MgO film 116. However, the MgO film 116 formed on the rear surface 115" of the barrier ribs 115 and the rear surface 111*a* of the substrate 111 do not have an effect on the operation of the plasma display module according to the present invention. The MgO film 116 formed on a rear surface 111*a* of the substrate 111 does not interrupt the passage of visible light since the thickness of the MgO film 116 is less than 1 μm (micron or micrometers) but is advantageous for generating secondary electrons.

The front discharge electrodes 113, the rear discharge electrodes 112, and the address electrodes 122 that surround the discharge cell 126 are disposed in the barrier ribs 115. The front discharge electrodes 113 and the rear discharge electrodes 112 are spaced apart from each other interposing a second barrier rib 115*b* which will be described later, and the rear discharge electrodes 112 and the address electrodes 122 are spaced apart from each other interposing a third barrier rib 115*c*.

Figure 5:
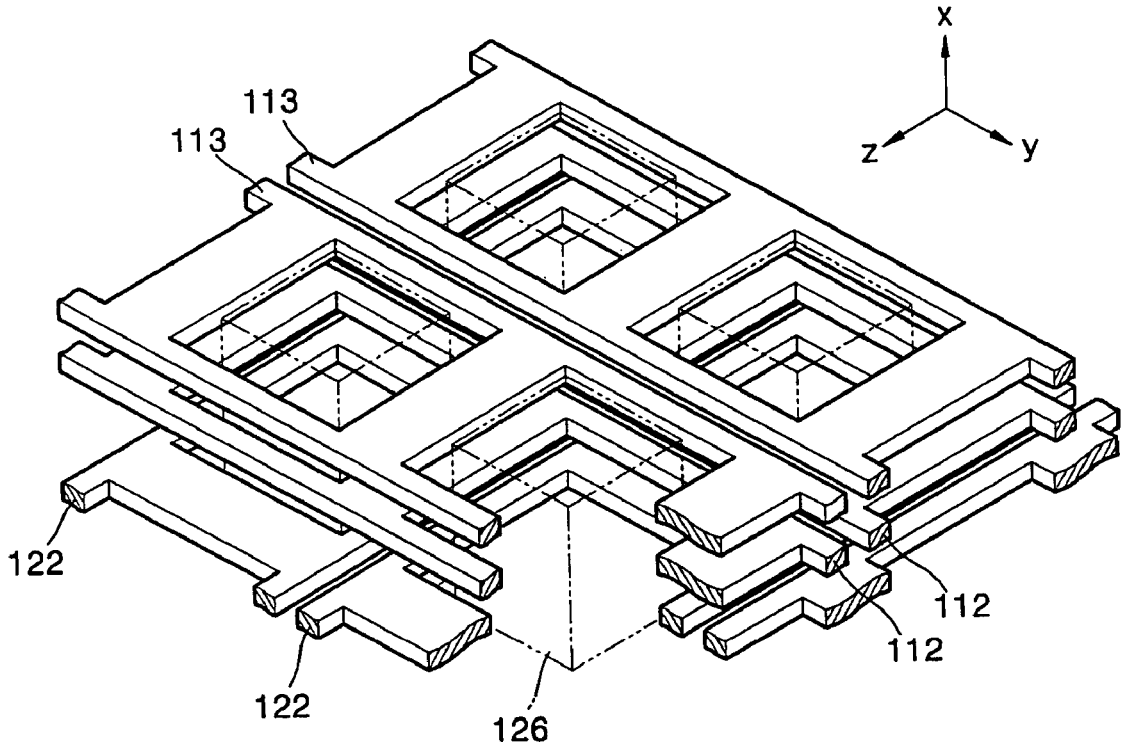
FIG. 5 is a cutaway perspective view of the structure of the electrodes of FIG. 4.

In the present embodiment, the front discharge electrodes 113 and the rear discharge electrodes 112 are extended in a direction, and the address electrodes 122 are extending to cross the front discharge electrodes 113 and the rear discharge electrodes 112. In FIG. 5, each of the front discharge electrodes 113, the rear discharge electrodes 112, and the address electrodes 122 are formed in a trapezoidal shape, but the present invention is not limited thereto, and this shape is advantageous for generating an address discharge and sustain discharge at all side surfaces of the discharge cell 126.

The front discharge electrodes 113 and the rear discharge electrodes 112 in the present embodiment surround the discharge cell 126 unlike the conventional sustain discharge electrodes 12 and 13. Therefore, the volume of space in which the sustain discharge occurs is relatively greater than in the prior art since the sustain discharge occurs along the circumference of the discharge cell 126. Therefore, the plasma display module according to the present embodiment has greater light emission efficiency than that of a conventional plasma display module.

The front discharge electrodes 113 and the rear discharge electrodes 112 are sustain discharge electrodes for displaying an image on the plasma display module. The front discharge electrodes 113 and the rear discharge electrodes 112 can be formed of a conductive metal, such as Ag, Al, or Cu, and the address electrodes 122 can also be formed of a conductive metal.

Two sustain discharge electrodes (a sustain discharge electrode pair), that is, an X and Y electrodes and one address electrode 122 are disposed in one discharge cell 126 of a plasma display module which is driven by an address discharge and sustain discharge. The address discharge is a discharge that is generated between the Y electrode and the address electrode 122. When the address electrode 122 is disposed on a rear side of the rear discharge electrode 112 like in the present embodiment, the rear discharge electrode 112 can be the Y electrode and the front discharge electrode 113 can be the X electrode. On the other hand, when the address electrode 122 is disposed on a front side of the front discharge electrode 113, the front discharge electrode 113 can be the Y electrode and the rear discharge electrode 112 can be the X electrode. In either case, the distance between the address electrode 122 and the Y electrode is less than 100 μm. Therefore, in the plasma display module according to the present embodiment, a time required for generating an address discharge and the address voltage for generating an address discharge can be reduced when compared to a conventional plasma display module.

A fluorescent layer 125 is formed in the discharge cell 126, more specifically, on a rear surface 111*a* of the substrate 111. The thickness T of the fluorescent layer 125 can be less than 15 μm since, if the fluorescent layer 125 is thick, the passage of visible light emitted from a lower part of the fluorescent layer 125 toward the substrate 111 may be interrupted. The fluorescent layer 125 can be formed by drying and annealing a paste that includes a phosphor after printing or dispensing the paste on a surface of the discharge cell 126.

The paste includes one of a red phosphor, a green phosphor, and a blue phosphor, a solvent, and a binder. The red phosphor can be $Y(V,P)O_4$:Eu, the green phosphor can be $Zn_2SiO_4$:Mn, or $YBO_3$:Tb, and the blue phosphor can be BAM:Eu.

A discharge gas is filled in the discharge cell 126. The discharge gas can be a gas mixture of Ne—Xe containing Xe 5-15%, and when it is necessary, a portion of Ne can be replaced by He.

A sealing region AS and a structure in the vicinity of the sealing region AS will now be described with reference to FIGS. 6 through 8. As it is seen from the drawings, the substrate 111 includes a display region AD, a sealing region AS, and a first connection unit AC1.

The ventilation region AT disposed between the display region AD and the sealing region AS is a region on which routes R for ventilating impure gasses from a space between the substrate 111 and the chassis base 150 and filling the discharge gas in the space after closely contacting the substrate 111 on which barrier rib layers 115*a*, 115*b*, 115*c*, and 115*d* and the electrodes 112, 113, and 122 are formed to the chassis base 150 using a method which will be described later. The ventilation region AT is connected to the vent hole which is closed with the plug P' described above.

The impure gases of the discharge cell 126 travel to the routes R through gaps (not shown) formed by tolerance between MgO film 116 and a front surface 150*a* of the chassis base 150, and the impure gases reached the routes are exhausted to the outside through the vent hole. The discharge gas is filled in the space through a reverse order of ventilating the impure gases. The ventilation region AT, on which routes R for passing gases are formed, can facilitate the ventilation of the impure gases and filling the discharge gas, but the routes R are not necessary.

A sealing member 130 is coated on the sealing region AS, and frit can be used as the sealing member 130. Frit is coated on the sealing region AS in a molten state, and the substrate 111 and the chassis base 150 can be sealed by drying and annealing the coating.

Figure 6:
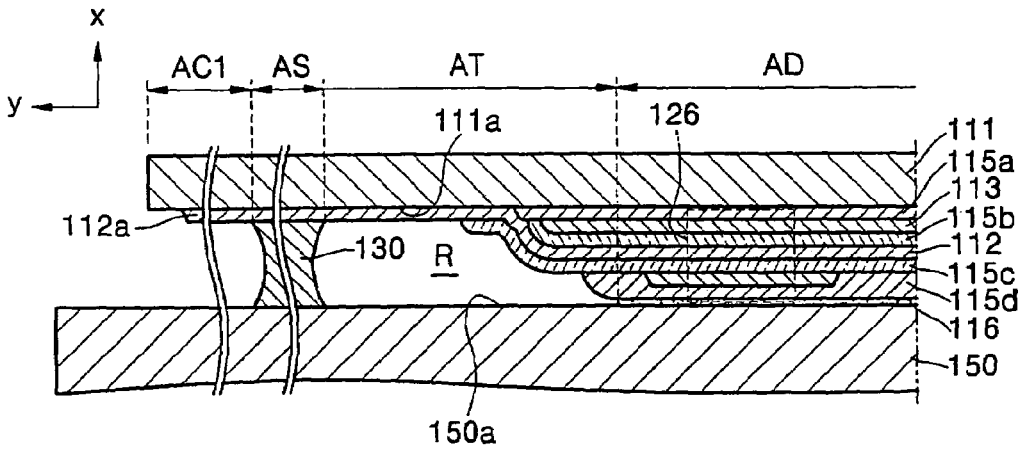
FIGS. 6 and 7 are cross-sectional views taken along line A-A of FIG. 3.
Figure 7:
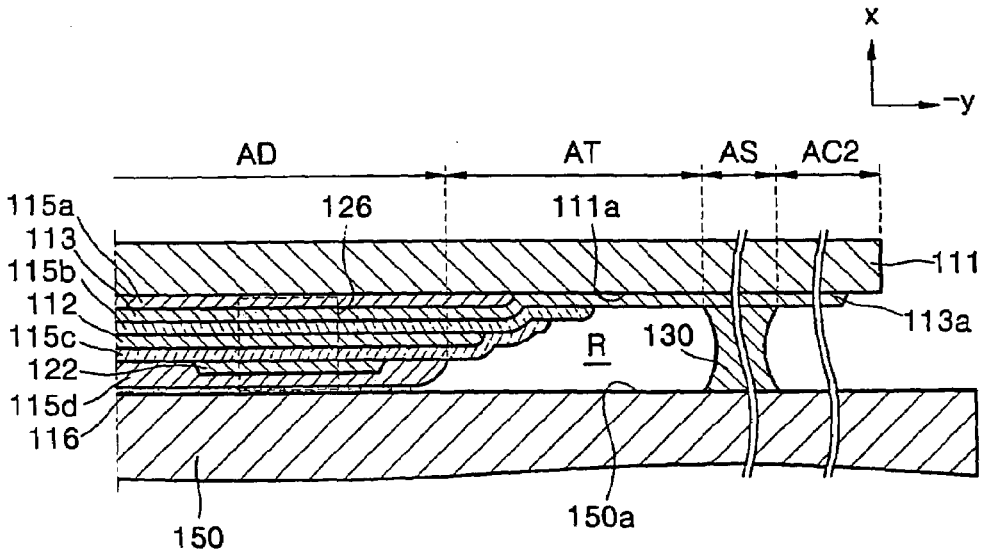
Figure 8:
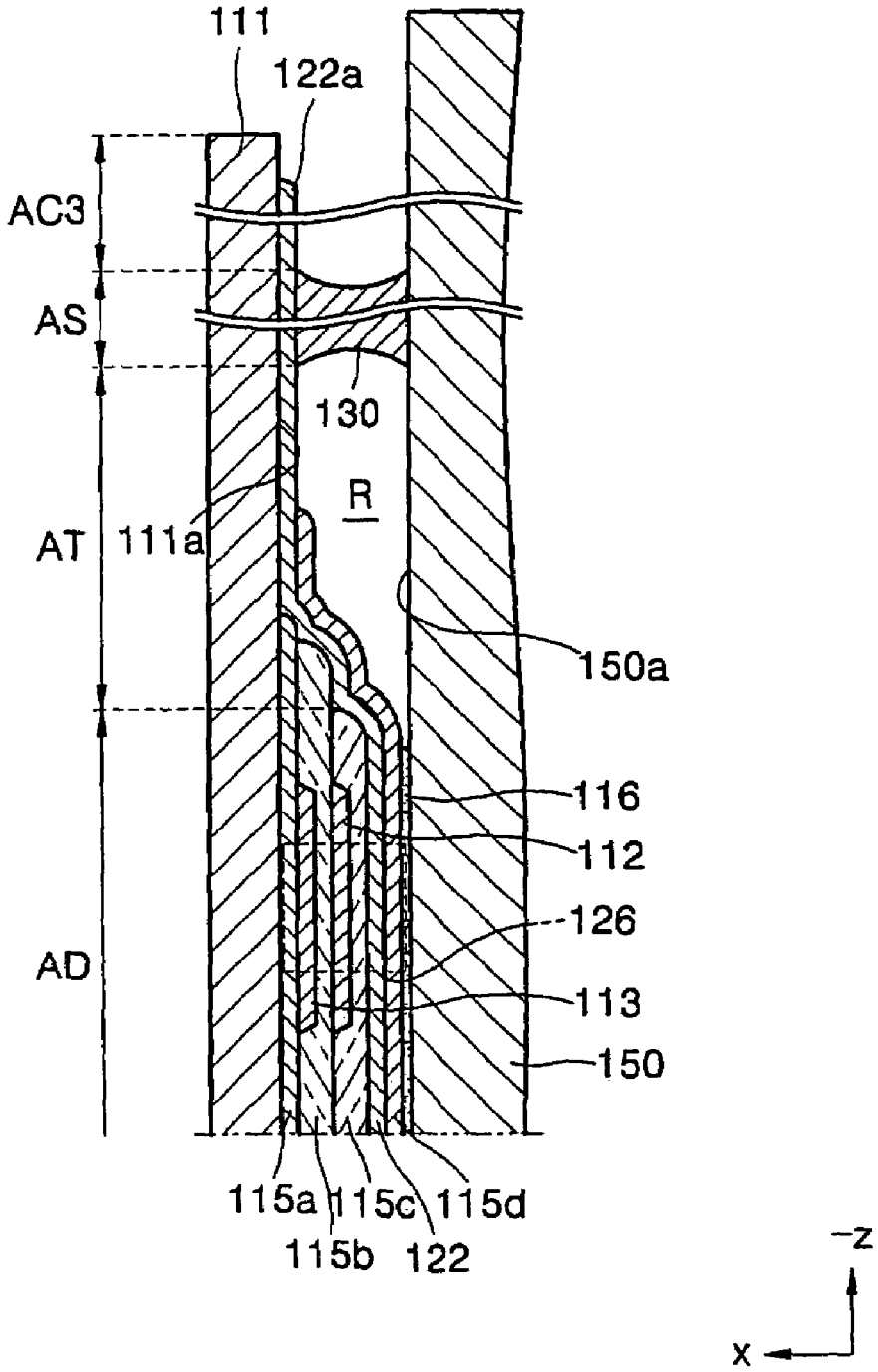
FIG. 8 is a cross-sectional view taken along line B-B of FIG. 3.

Each of the end parts 112*a* of the rear discharge electrodes 112 depicted in FIG. 6 (a cross-section of the first connection unit AC1) are respectively connected to wires formed on the connection cable 53, each of the end parts 113*a* of the front discharge electrodes 113 depicted in FIG. 7 (a cross-section of the second connection unit AC2) are respectively connected to wires formed on the connection cable 54, and each of the end parts 122*a* of the address electrodes 122 depicted in FIG. 8 (a cross-section of the third connection unit AC3) are respectively connected to wires formed on the connection cable 51. The connection of the cross-section of the fourth connection unit AC4 is omitted since it is symmetrical to the cross-section depicted in FIG. 8.

The operation of a plasma display module having the above structure will now be described. An address discharge occurs by applying an address voltage between the address electrode 122 and the rear discharge electrode 112, and as a result of the address discharge, a discharge cell 126 in which a sustain discharge occurs is selected. The selection of a discharge cell 126 denotes that wall charges are accumulated on a region of the barrier ribs 115 (the MgO film 116 if the barrier rib 115 is covered by the MgO film 116) adjacent to the front discharge electrode 113 and the rear discharge electrode 112. When the address discharge is completed, positive ions accumulate in a region adjacent to the rear discharge electrode 112 and electrons accumulate in a region adjacent to the front discharge electrode 113.

After the address discharge, when a sustain discharge voltage is applied between the front discharge electrode 113 and the rear discharge electrode 112, a sustain discharge occurs by colliding the positive ions accumulated in a region adjacent to the rear discharge electrode 112 with the electrons accumulated in a region adjacent to the front discharge electrode 113. As the sustain discharge continues, a discharge sustain voltage is repeatedly applied inversely to the rear discharge electrode 112 and the front discharge electrode 113.

The energy level of the discharge gas increases by the sustain discharge, and the discharge gas emits ultraviolet rays with an energy level of the discharge gas reducing. The ultraviolet rays increase the energy level of a phosphor included in the fluorescent layer 125 disposed in the discharge cell 126. Visible light is generated as the energy level of the fluorescent layer 125 reduces. An image is displayed on the plasma display module by the visible light emitted from each of the discharge cells 126.

A method of manufacturing the plasma display module according to the first embodiment will now be described in detail with reference to FIGS. 9 through 19. This method includes operations of (a), (b), (c), and (d) which will be described later.

The operation (a) is a step for preparing a substrate 111 formed of a transparent insulator and a chassis base 150 formed of an insulator, the operation (b) is a step for alternately forming the barrier rib layers on a rear surface 111*a* of the substrate 111 and the electrodes 112, 113, and 122, the operation (c) is a step for forming a fluorescent layer 125 on a rear surface 111*a* of the substrate 111 that defines the discharge cells 126 partitioned by the barrier ribs 115 formed by the barrier rib layers, and the operation (d) is a step for filling a discharge gas in a space formed by sealing the substrate 111 and the chassis base 150 after sealing the space.

Figure 9:
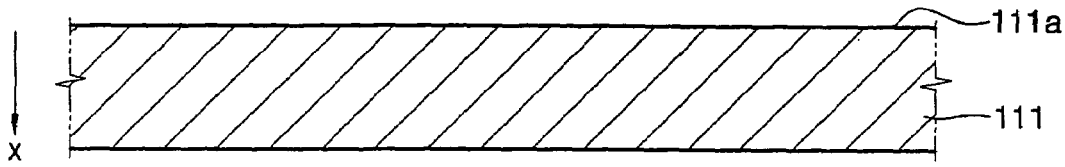
FIGS. 9 through 19 are cross-sectional views taken along line C-C of FIG. 4 for describing a method of manufacturing a plasma display module according to a first embodiment of the present invention.

The substrate 111 prepared in the operation (a) can be formed of an insulator having high light transmittance such as glass. The chassis base 150 prepared in the operation (a) can be formed of an insulator such as a plastic. Referring to FIG. 9, a substrate 111 is prepared. The prepared chassis base 150 is not shown. The plasma display module according to the present embodiment does not include the rear substrate 21 unlike a conventional plasma display module. Therefore, an equipment line for manufacturing the rear substrate 21 is unnecessary and a space for installing the equipment can be reduced, thereby reducing the manufacturing cost.

In preparing the chassis base 150, the chassis base 150 preferably has an MgO film on a front surface 150*a* of the chassis base 150 since the MgO film generates many secondary electrons that facilitate the plasma discharge.

In the operation (b), the barrier rib layers 115*a*, 115*b*, 115*c*, and 115*d* and the electrodes 113, 112, and 122 are alternately formed on a rear surface 111*a* of the substrate 111.

Figure 10:
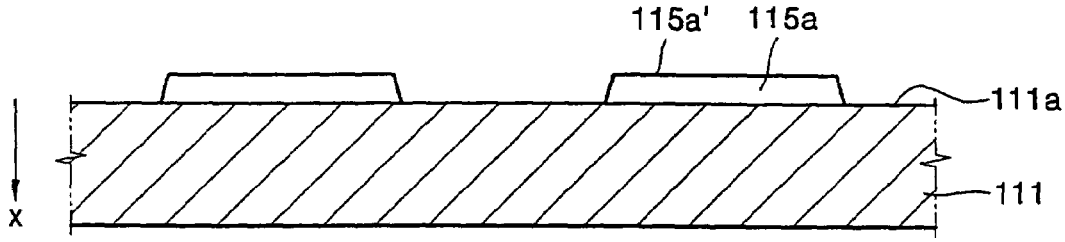

First, the first barrier rib layer 115*a* is formed on a rear surface 111. The first barrier rib layer 115*a* is formed to a predetermined pattern by drying a dielectric paste printed on a rear surface 111*a* of the substrate 111. The method of patterning the first barrier rib layer 115*a* to a predetermined pattern, can be a method of printing a dielectric paste in a predetermined pattern in advance, or a method using sandblasting to remove a portion that is unnecessary after printing a dielectric paste on the entire rear surface 111*a* of the substrate 111. An annealing process can be performed after drying the first barrier rib layer 115*a*, if necessary. The formed first barrier rib layer 115*a* is depicted in FIG. 10.

Figure 11:
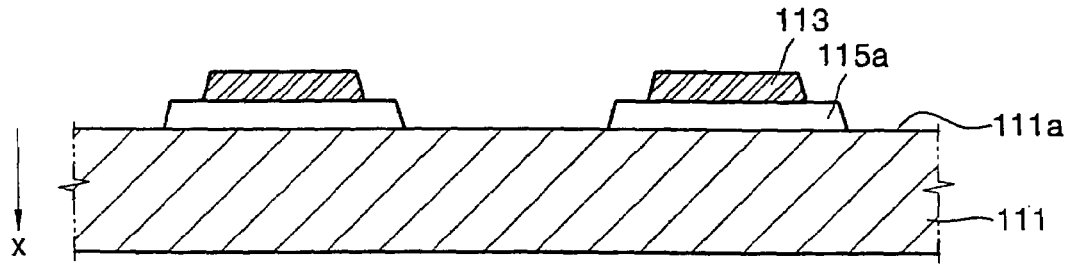

The front discharge electrode 113 is formed after the formation of the first barrier rib layer 115*a* is completed. The front discharge electrode 113 is formed by performing drying, exposing, and developing a layer formed of a paste in which a conductive metal, such as Ag, Cu, or Al is included after printing, such as screen printing, the paste on a rear surface 115*a'* of the first barrier rib layer 115*a*. The formed front discharge electrode 113 is depicted in FIG. 11.

Figure 12:
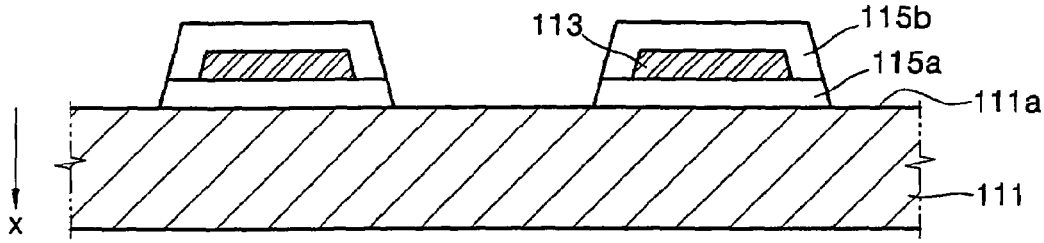

The second barrier rib layer 115*b* that covers the front discharge electrode 113 is formed after the formation of the front discharge electrode 113 is completed. The second barrier rib layer 115*b* is formed by an identical or a similar method for forming the first barrier rib layer 115*a* and the formed second barrier rib layer 115*b* is depicted in FIG. 12.

Figure 13:
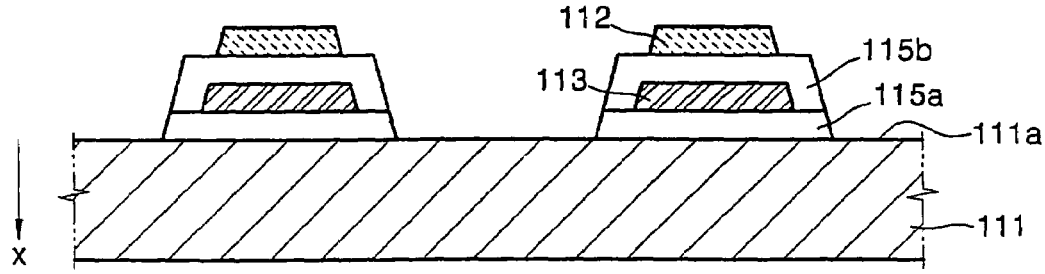

Next, the rear discharge electrode 112 is formed after the formation of the second barrier rib layer 115*b* is completed. The rear discharge electrode 112 is formed by an identical or a similar method for forming the front discharge electrode 113 and the formed rear discharge electrode 112 is depicted in FIG. 13.

Figure 14:
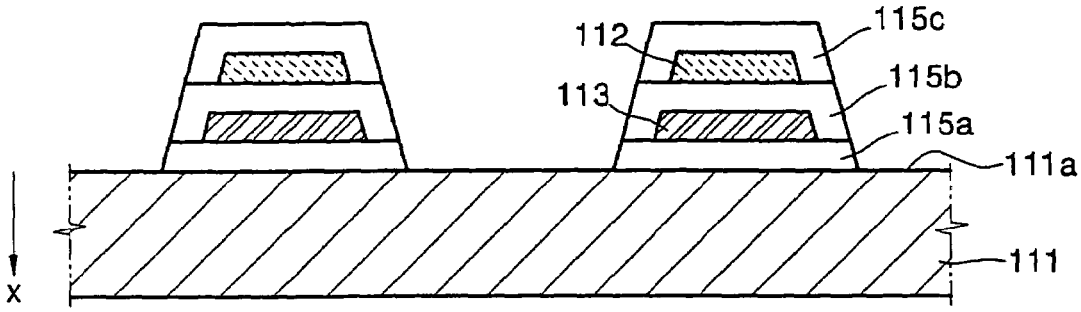

The third barrier rib layer 115*c* that covers the rear discharge electrode 112 is formed after the formation of the rear discharge electrodes 112 is completed. The third barrier rib layer 115*c* is formed by an identical or a similar method for forming the first barrier rib layer 115*a* and the formed third barrier rib layer 115*c* is depicted in FIG. 14.

Figure 15:
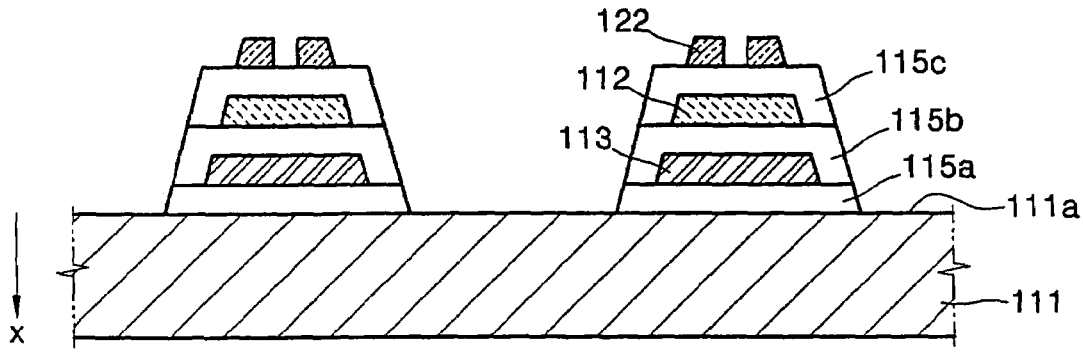

The address electrode 22 is formed after the formation of the third barrier rib layer 115*c* is completed. The address electrode 122 is formed by an identical or a similar method for forming the front discharge electrode 113 but the pattern is formed different from the front discharge electrode 113, and the formed address electrode 122 is depicted in FIG. 15.

Figure 16:
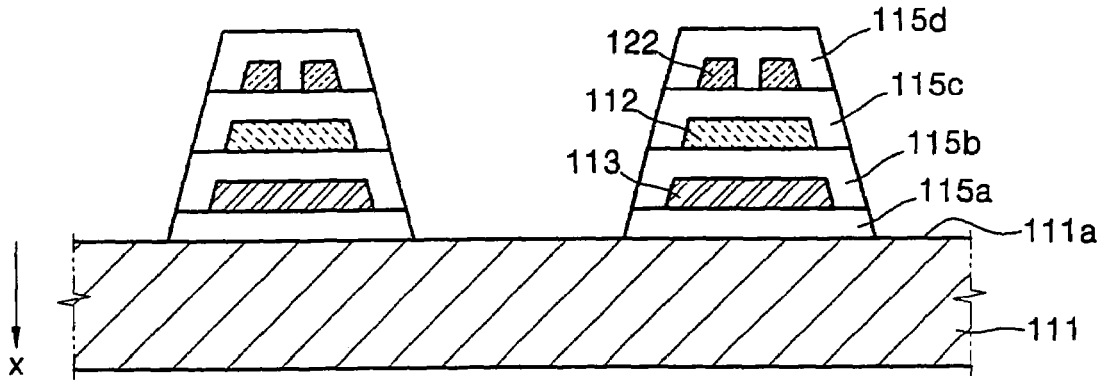

The fourth barrier rib layer 115*d* that covers the address electrode 122 is formed after the formation of the address electrode 122 is completed. The fourth barrier rib layer 115*d* is formed by an identical or a similar method for forming the first barrier rib layer 115*a* and the formed second barrier rib layer 115*b* is depicted in FIG. 16.

Each of the first barrier rib layer 115*a*, the second barrier rib layer 115*b*, the third barrier rib layer 115*c*, and the fourth barrier rib layer 115*d* can be formed by stacking more than two layers to increase the thickness thereof. Also, the second barrier rib layer 115*b* and the third barrier rib layer 115*c* are requisite for insulating the electrodes but the first barrier rib layer 115*a* and the fourth barrier rib layer 115*d* may not be formed since the first barrier rib layer 115*a* and the fourth barrier rib layer 115*d* are not requisite and are used for securing the discharge space.

In the operation (b), the front discharge electrode 113 formed between the first barrier rib layer 115*a* and the second barrier rib layer 115*b* is extended in a direction, the rear discharge electrode 112 formed between the second barrier rib layer 115*b* and the third barrier rib layer 115*c* is extended parallel to the front discharge electrode 113, and the address electrode 122 formed between the third barrier rib layer 115*c* and the fourth barrier rib layer 115*d* is extended to cross the front discharge electrode 113. Also, the front discharge electrode 113, the rear discharge electrode 112, and the address electrode 122 are formed to surround the discharge cell 126.

In FIG. 5, the front discharge electrode 113, the rear discharge electrode 112, and the address electrode 122 are formed in a trapezoidal shape, but the present invention is not limited thereto. Also, in the present embodiment, the address electrode 122 is disposed on a rear side of the rear discharge electrode 112, but the address electrode 122 can be disposed on a front side of the front discharge electrode 113.

Figure 18:
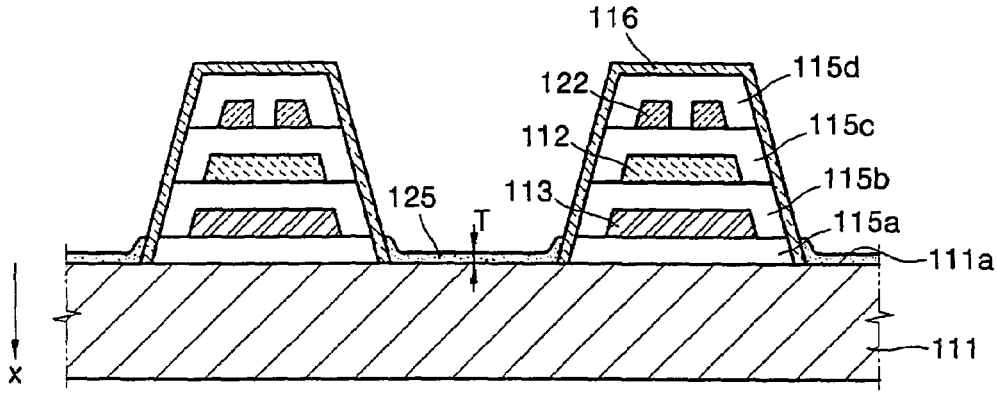

The operation of (c) is a step for forming the fluorescent layer 125 on a front side of the discharge cells 126 defined partitioned by the barrier rib layers 115*a*, 115*b*, 115*c*, and 115*d*, more specifically, on a rear surface 111*a* of the substrate 111. The fluorescent layer 125 can be formed by drying and annealing a paste that includes a phosphor after printing or dispensing the paste on a rear surface 111*a* of the substrate 111. The thickness T of the fluorescent layer 125 is preferably less than 15 μm (microns) after annealing. The formed fluorescent layer 125 is depicted in FIG. 18.

Figure 17:
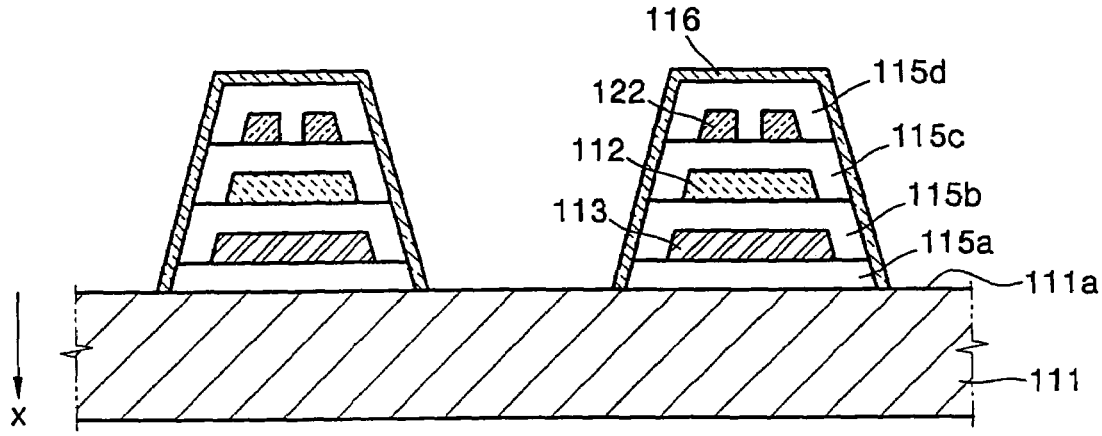

An operation for forming the MgO film 116 on a side surface 115' of the barrier rib 115 can further be included before or after the operation (c). The MgO film 116 can be formed in a thickness of less than 1 μm, such as 0.7 μm. The MgO film 116 prevents the barrier ribs 115 formed of a dielectric from sputtering by positive ions when a plasma discharge occurs and generates many secondary electrons that facilitate the plasma discharge. In the present embodiment, the MgO film 116 is formed before performing the operation (c), and the formed MgO film 116 is depicted in FIG. 17.

When the MgO film 116 is formed by deposition before performing the operation (c), the MgO film 116 is formed between the fluorescent layer 125 and the substrate 111. When the MgO film 116 is formed by deposition after performing the operation (c), the MgO film 116 can be formed on the fluorescent layer 125. In both cases, the MgO film 116 is formed on a rear surface 115" of the barrier rib 115. The MgO film 116 formed in both cases does not adversely affect the operation of the plasma display module.

The MgO film 116 can be deposited in a predetermined pattern before or after the operation (c) by disposing a mask having a predetermined pattern on a rear side of the barrier rib 115. The mask can have an arbitrary pattern so that the MgO film 116 can be formed only on a side surface 115' of the barrier rib 115.

The operation (d) is performed after the operations (a) through (c) are completed. In the operation (d), the substrate 111 and the chassis base 150 are bonded and a space formed between the substrate 111 and the chassis base 150 is sealed from the outside. The sealing is performed such that a molten state of sealing member 130, such as frit, is coated on the sealing region AS of the substrate 111 and/or the chassis base 150 and the substrate 111 and the chassis base 150 are bonded prior to hardening the sealing member 130. Afterward, the sealing is completed by annealing the frit.

Figure 19:
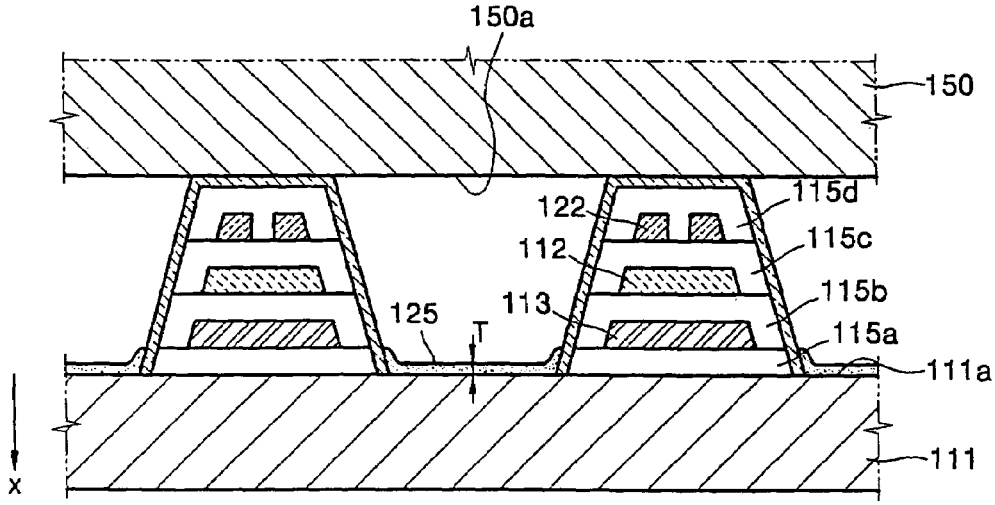

After the space between the substrate 111 and the chassis base 150 is sealed by the sealing member, impure gases present in the space are exhausted. Then, a discharge gas is filled in the space through a vent hole formed on the chassis base 150. When the filling of the discharge gas is completed, the vent hole is closed using a plug P'. The sealed and bonded state of the substrate 111 and the chassis base 150 is depicted in FIG. 19.

The description of manufacturing the circuit substrates 61, 62, 63, 64, 65, and 66, mounting the circuit substrates 61, 62, 63, 64, 65, and 66 on a rear side of the chassis base 150, and connecting the end parts 112*a*, 113*a*, and 122*a* of the electrodes formed on the substrate 111 using the connection cables 51, 52, 53, 54, and 55 are omitted since techniques for these are well known in the art.

Figure 20:
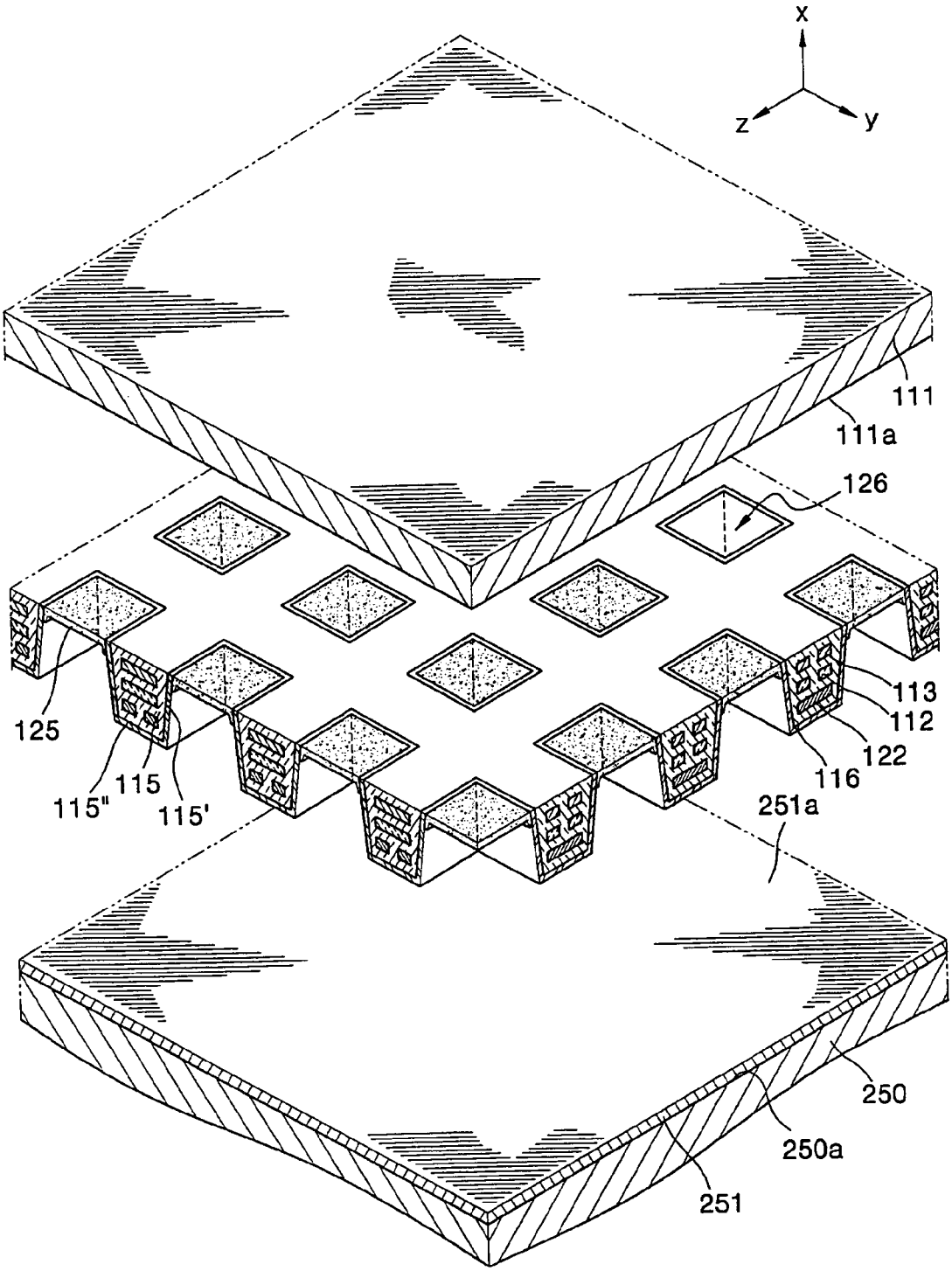
FIG. 20 is an exploded perspective view of a display region of the plasma display module according to a first modified version of the first embodiment of the present invention.

A first modified version of the first embodiment with respect to mainly the differences from the first embodiment will now be described with reference to FIG. 20. The different point of the present modified version from the first embodiment is that a chassis base 250 is formed of a conductive material and an insulating layer 251 is formed on a front surface 250*a* of the chassis base 250.

A large amount of heat is generated in the discharge cell when plasma discharges occur. However, if the chassis base 250 is formed of a non-conductive material, such as plastic, as in the first embodiment, the heat generated locally in the display region AD cannot be easily dissipated to other elements. In this case, a latent image may be generated on the portion on which heat is accumulated, thereby degrading the image quality. Also, after long hours of operation of the plasma display module, the image quality of the whole display region AD may be degraded.

In the present modified version, the chassis base 250 is formed of a conductive material, such as Al, since the conductive material has a greater thermal conductivity than the insulator. However, an insulating layer 251 can be formed on a front surface 250*a* of the chassis base 250 since serious problems from the plasma discharge could arise if the conductive material is exposed to the discharge cell 126.

Furthermore, the front surface 251*a* of the insulating layer 251 is preferably covered by an MgO film (not shown) since the MgO film emits many secondary electrons which facilitate the plasma discharge.

The method of manufacturing the plasma display module according to the present modified version is at least similar to the method of manufacturing the plasma display module described in the first embodiment. However, they are different as follows in the operation (a).

That is, in the operation (a), a chassis base 250 formed of a conductive material must be prepared and the insulating layer 251 is formed on a front surface 250*a* of the chassis base 250. Then, an MgO film (not shown) can be formed on a front surface 251*a* of the insulating layer 251.

Elements that are not described in the first modified version of the first embodiment are identical to the elements of the first embodiment.

Figure 21:
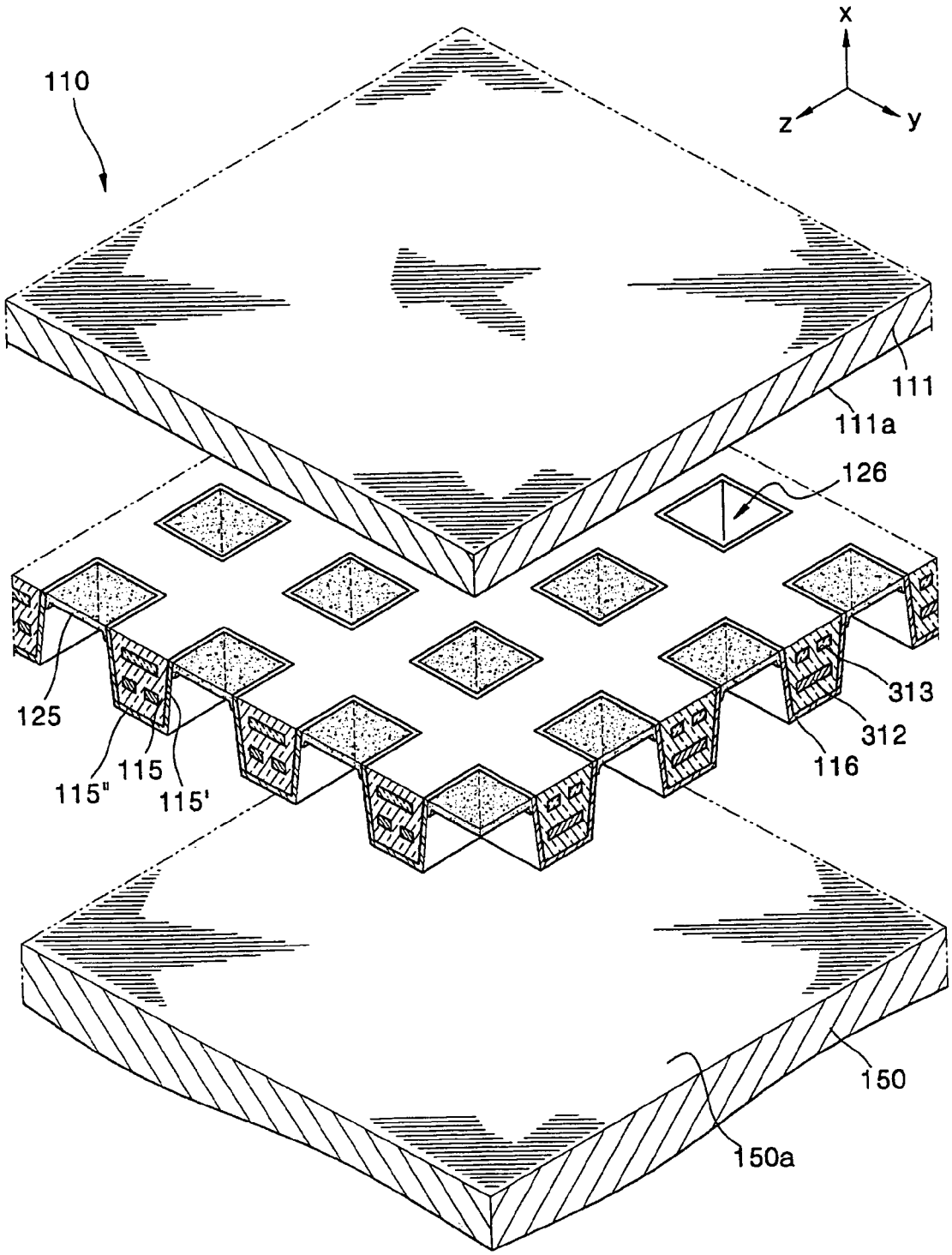
FIG. 21 is an exploded perspective view of a display region of the plasma display module according to a second modified version of the first embodiment of the present invention.
Figure 22:
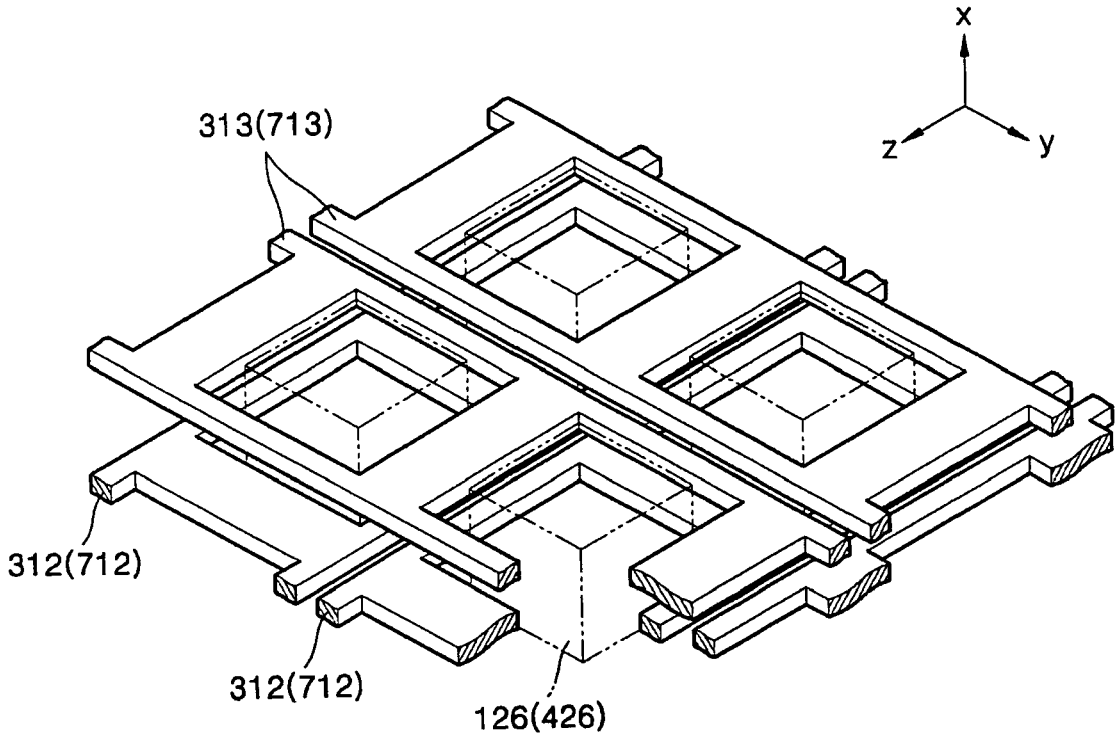
FIG. 22 is a cutaway perspective view of the structure of electrodes of FIG. 21.

A second modified version of the first embodiment with respect to mainly the difference from the first embodiment will now be described with reference to FIGS. 21 and 22. The difference of the present embodiment from the first embodiment is that there is no address electrode 122 in the present embodiment.

Only two discharge electrodes can generate a discharge in a specific discharge cell 126. Therefore, the address electrodes 122 are not requisite for generating a discharge in the discharge cell 126. However, if there is no address electrode, the front discharge electrodes 313 and the rear discharge electrodes 312 are extended to cross each other so that a discharge cell 126 in which the discharge occurs can be selected. The structure of the electrodes is shown in FIG. 22.

In the present embodiment, only three barrier rib layers are required to dispose the electrodes between the barrier rib layers since there is no address electrode, and only one barrier rib layer can be required since the foremost and the rearmost barrier rib layers are unnecessary. In this case, the one barrier rib layer is disposed between the front discharge electrode 313 and the rear discharge electrode 312.

The method of manufacturing the plasma display module according to the present modified version is omitted since the method is similar to the method of manufacturing the plasma display module according to the first embodiment.

The second modified version of the first embodiment can be combined with the first modified version of the first embodiment.

Elements that are not described in the second modified version of the first embodiment are identical to the elements of the first embodiment.

A plasma display module according to the second embodiment will now be described with reference to FIGS. 23 through 27.

The plasma display module includes a substrate 411, a chassis base 450, a plurality of barrier ribs 415, an MgO film 416, a plurality of front discharge electrodes 413, a plurality of rear discharge electrodes 412, a plurality of address electrodes 422, a fluorescent layer 425, a discharge gas, and a plurality of circuit substrates 61, 62, 63, 64, 65, and 66.

The chassis base 450 is formed of an insulator, such as plastic, and is disposed on a rear (−X direction) of the substrate 411. The insulator can be formed of a material having a resistance to heat generated by a discharge in a discharge cell 426 and high thermal conductivity. Also, a front surface 450*a* of the chassis base 450 is flat since the chassis base 450 defines discharge cells 426 by coupling with the substrate 411.

The chassis base 450 supports the circuit substrates 61, 62, 63, 64, 65, and 66 disposed on a rear (−X direction) of the chassis base 450. Although it is not depicted in the drawing, but the front surface 450*a* of the chassis base 450 can be covered by an MgO film (not shown) since the MgO film emits many secondary electrons which facilitate the plasma discharge.

The circuit substrates 61, 62, 63, 64, 65, and 66 apply electrical signals to electrodes 413, 412, and 422 which will be described later. The circuit substrates 61, 62, 63, 64, 65, and 66 are connected to each other through a connection cable 55, the circuit substrates 65 and 66 are connected to end parts 422*a* of the address electrodes 422 respectively by the connection cables 51 and 52, the circuit substrate 63 is connected to end parts 412*a* of the rear discharge electrode 412 by the connection cable 53, and the circuit substrate 64 is connected to end parts 413*a* of the front discharge electrode 413 by the connection cable 54.

Figure 23:
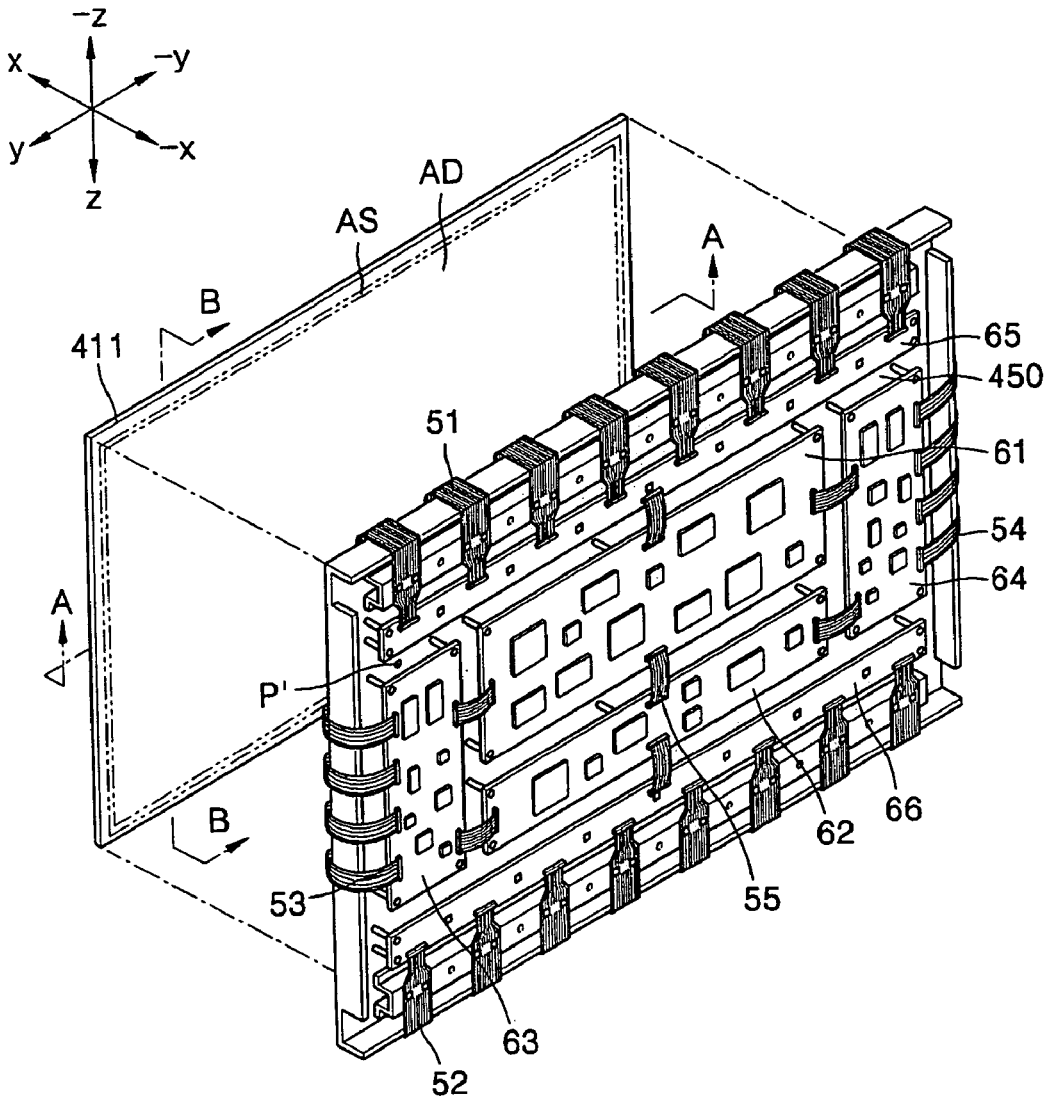
FIG. 23 is an exploded perspective view of a plasma display module according to a second embodiment of the present invention.

The PDP depicted in FIG. 23 is driven by a dual addressing method, in which the address electrodes 422 are divided on uppermost and lowermost sections (−Z direction and +Z direction) of the chassis base 450. Therefore, two circuit substrates 65 and 66 for applying an address signal to the address electrodes 422 are required. However, in a PDP in which the address electrodes are not divided, one of the above circuit substrates 65 and 66 is required.

The substrate 411 is formed of a transparent insulator such as glass. The substrate 411 includes a display region AD on which an image is displayed and a sealing region AS, on which a sealing member, such as frit that bonds the chassis base 450 and the substrate 411, is coated and surrounds the display region AD.

Figure 25:
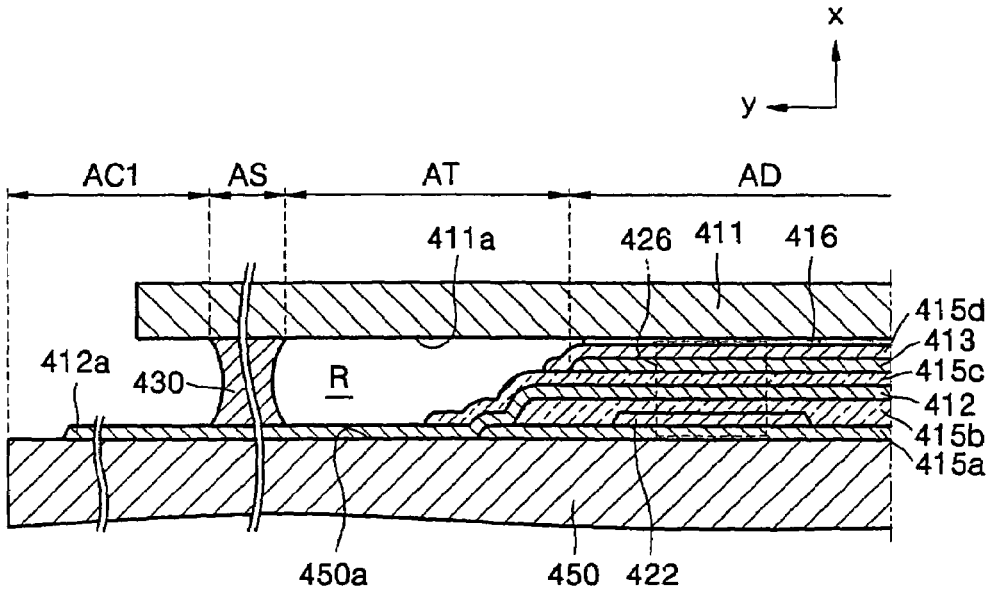
FIGS. 25 and 26 are cross-sectional view taken along line A-A of FIG. 23.
Figure 26:
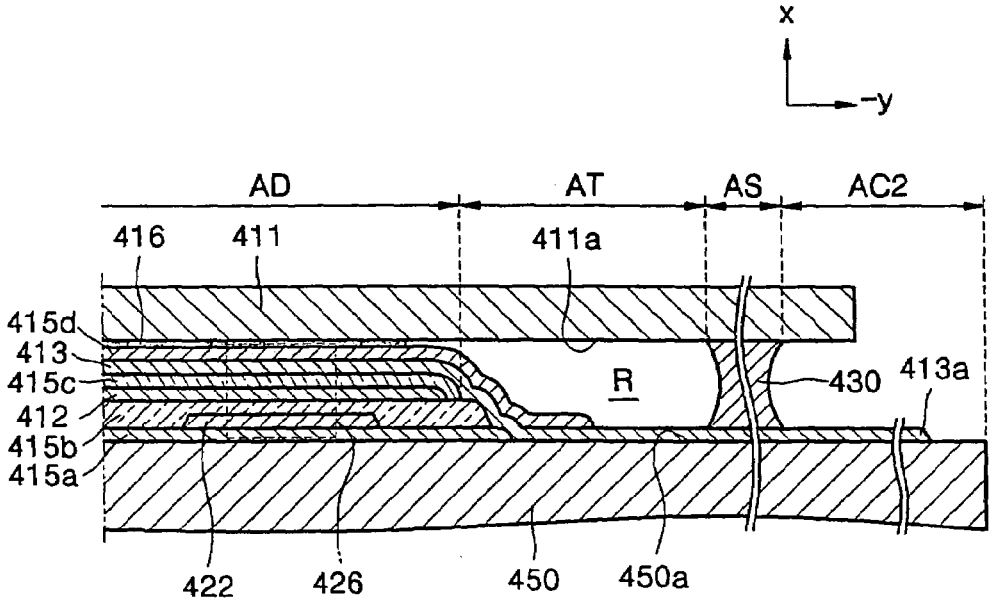
Figure 27:
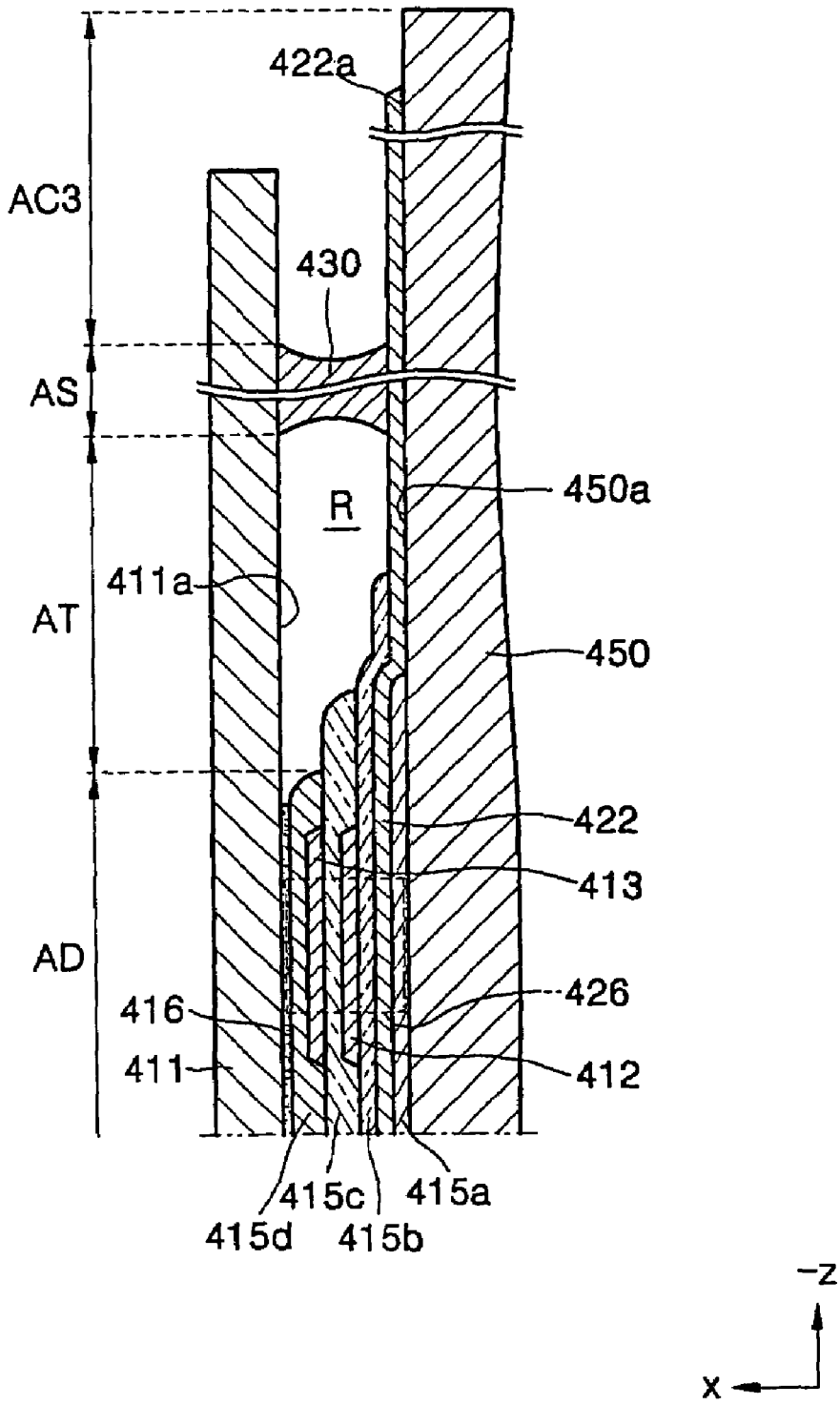
FIG. 27 is a cross-sectional view taken along line B-B of FIG. 23.

Referring to FIGS. 25 through 27, the barrier ribs 415 are formed by barrier rib layers 415*a*, 415*b*, 415*c*, and 415*d*, the electrodes 413, 412, and 422 are interposed between the barrier rib layers, and each of the end parts 413*a*, 412*a*, and 422*a* are formed on a front surface 450*a* of the chassis base 450. Accordingly, as depicted in FIG. 23, the connection units AC1, AC2, AC3, and AC4 are disposed on the chassis base 450 not on the substrate 411 unlike in the first embodiment. A plug P' depicted in FIG. 23 is for closing a vent hole formed on the chassis base 450.

The sustain discharge electrode pair 14 disposed on a rear surface 11*a* of the substrate 11 and the front dielectric layer 15 that covers the sustain discharge electrode pair 14 of a conventional the PDPs are not formed on a portion of a rear surface 411*a* of the substrate 411 that defines the discharge cell 426. Therefore, greater than 80% of the visible light emitted from the fluorescent layer 425, which will be described later, can pass the substrate 411, thereby improving the emission efficiency of light of the plasma display module.

Although it is not shown in the drawing, the rear surface 411*a* of the substrate 411 can be covered by an MgO film (not shown) since the MgO film emits many secondary electrons that facilitate the plasma discharge. If the thickness of the MgO film is formed to less than 0.7 μm (microns), the MgO film does not interrupt the passage of visible light emitted from the fluorescent layer 425.

In the present embodiment, the barrier ribs 415 and the fluorescent layer 425 are formed on a front surface 450*a* of the chassis base 450 unlike in the first embodiment. The barrier ribs 415 define the discharge cells 426 together with the substrate 411 and the chassis base 450, and are formed of a dielectric. The arrangement and the shape of the cross-section of the discharge cells 426 are not limited to the arrangement and the shape depicted in FIG. 24.

The barrier ribs 415 can prevent cross-talk between the rear discharge electrodes 412, the front discharge electrodes 413, and the address electrodes 422 and the damage of the electrodes 412, 413, and 422 by colliding with charged particles. The dielectric can be PbO, $B_2O_3$, or $SiO_2$.

Figure 24:
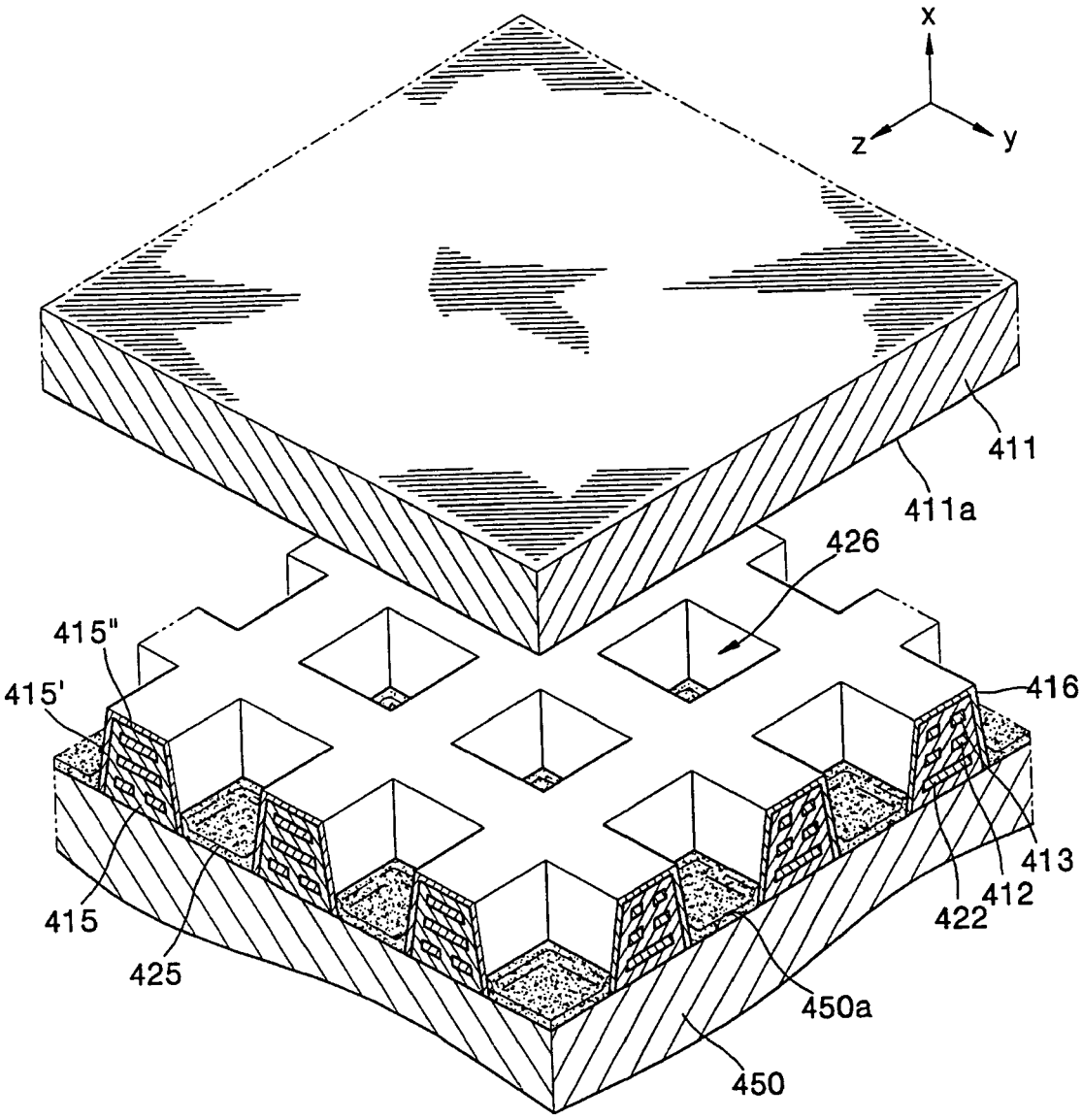
FIG. 24 is an exploded perspective view of a display region of the plasma display module of FIG. 23.

Referring to FIG. 24, at least side surfaces 415' of the barrier ribs 415 can be covered by the MgO film 416. The MgO film 416 can be formed by deposition. Further, the MgO film 416 can be deposited on a front surface 415" of the barrier ribs 415 and a front surface 450*a* of the chassis base 450. However, the MgO film 416 formed on the front surface 415" of the barrier ribs 415 and the front surface 450*a* of chassis base 450 do not affect the operation of the plasma display module according to the present invention.

The front discharge electrodes 413, the rear discharge electrodes 412, and the address electrodes 422 that surround the discharge cell 426 are disposed in the barrier ribs 415. The front discharge electrodes 413 and the rear discharge electrodes 412 are spaced apart from each other interposing a third barrier rib 415*c* which will be described later, and the rear discharge electrodes 412 and the address electrodes 422 are spaced apart from each other interposing a second barrier rib 415*b*.

In the present embodiment, the front discharge electrodes 413 and the rear discharge electrodes 412 are extended in a direction, and the address electrodes 422 are extending to cross the front discharge electrodes 413 and the rear discharge electrodes 412. The arrangement of the electrodes 412, 413, and 422 is the same as the structure depicted in FIG. 5. In FIG. 5, each of the front discharge electrodes 413, the rear discharge electrodes 412, and the address electrodes 422 are formed in a trapezoidal shape, but the present invention is not limited thereto, and this shape is advantageous for generating an address discharge and sustain discharge at all side surfaces of the discharge cell 426.

The front discharge electrodes 413 and the rear discharge electrodes 412 in the present embodiment surround the discharge cell 426 unlike the conventional sustain discharge electrodes 12 and 13. Therefore, the volume of space in which the sustain discharge occurs is relatively greater than in the conventional art since the sustain discharge occurs along the circumference of the discharge cell 426. Therefore, the plasma display module according to the present embodiment has greater light emission efficiency than that of a conventional plasma display module.

The front discharge electrodes 413 and the rear discharge electrodes 412 are electrodes and a sustain discharge for displaying an image on the plasma display module occurs therebetween. The front discharge electrodes 413 and the rear discharge electrodes 412 can be formed of a conductive metal, such as Ag, Al, or Cu, and the address electrodes 422 can also be formed of a conductive metal.

Two sustain discharge electrodes (a sustain discharge electrode pair), that is, an X and Y electrodes and one address electrode 422 are disposed in one discharge cell 426 of a plasma display module which is driven by an address discharge and sustain discharge. The address discharge is a discharge generating between the Y electrode and the address electrode 422. When the address electrode 422 is disposed on a rear side of the rear discharge electrode 412, as in the present embodiment, the rear discharge electrode 412 can be the Y electrode and the front discharge electrode 413 can be the X electrode. On the other hand, when the address electrode 422 is disposed on a front side of the front discharge electrode 413, the front discharge electrode 413 can be the Y electrode and the rear discharge electrode 412 can be the X electrode. In either case, the distance between the address electrode 422 and the Y electrode is less than 100 μm. Therefore, in the plasma display module according to the present embodiment, a time required for generating an address discharge and the address voltage for generating address discharge can be reduced when compared to a conventional plasma display module.

A fluorescent layer 425 is formed in the discharge cell 426, more specifically, on a front surface 450*a* of the chassis base 450 that defines the discharge cell 426. The thickness T of the fluorescent layer 425 can be less than 15 μm since, if the fluorescent layer 425 is thick, the passage of visible light emitted from a lower part of the fluorescent layer 425 toward the substrate 411 may be interrupted. The fluorescent layer 425 can be formed by drying and annealing a paste that includes a phosphor after printing or dispensing the paste on a surface of the discharge cell 426.

The paste includes one of a red phosphor, a green phosphor, and a blue phosphor, a solvent, and a binder. The red phosphor can be $Y(V,P)O_4$:Eu, the green phosphor can be $Zn_2SiO_4$:Mn, or $YBO_3$:Tb, and the blue phosphor can be BAM:Eu.

A discharge gas is filled in the discharge cell 426. The discharge gas can be a gas mixture of Ne—Xe containing Xe 5-15%, and when it is necessary, a portion of Ne can be replaced by He.

A sealing region AS and a structure in the vicinity of the sealing region AS will now be described with reference to FIGS. 25 through 27. As it can be seen from the drawings, the substrate 411 is divided into the display region AD and the sealing region.

The ventilation region AT disposed between the display region AD and the sealing region AS is a region on which routes R that facilitate the ventilation of impure gasses from a space between the substrate 411 and the chassis base 450 and filling the discharge gas in the space after closely contacting the substrate 411 to the chassis base 450 on which barrier rib layers 415*a*, 415*b*, 415*c*, and 415*d* and the electrodes 412, 413, and 422 are formed using a method which will be described later. The ventilation region AT is connected to the vent hole which is closed with the plug P' described above.

The impure gases of the discharge cell 426 travel to the routes R through gaps (not shown) formed by tolerance between the MgO film 116 and a rear surface 411*a* of the substrate 411, and the impure gases reached the routes R are exhausted to the outside through the vent hole. The discharge gas is filled in the space through a reverse order of ventilating the impure gases. The ventilation region AT, on which routes R for passing gases are formed, can facilitate the ventilation of the impure gases and filling the discharge gas, but the routes R are not requisite.

A sealing member 430 is coated on the sealing region AS, and frit can be used as the sealing member 430. Frit is coated on the sealing region AS in a molten state, and the substrate 411 and the chassis base 450 can be sealed by drying and annealing the coating.

Each of the end parts 412*a* of the rear discharge electrodes 412 depicted in FIG. 25 are respectively connected to wires formed on the connection cable 53, each of the end parts 413*a* of the front discharge electrodes 413 depicted in FIG. 26 are respectively connected to wires formed on the connection cable 54, and each of the end parts 422*a* of the address electrodes 422 depicted in FIG. 27 are respectively connected to wires formed on the connection cable 51.

The plasma display module having the above configuration is operated as the manner described in the first embodiment.

A method of manufacturing the plasma display module according to the second embodiment mainly with respect to the difference from the first embodiment will now be described.

The method of manufacturing the plasma display module according to the second embodiment also includes operations of (a), (b), (c), and (d) as in the first embodiment. The operations of (a) and (d) of the second embodiment are identical respectively to the operations of (a) and (d) of the first embodiment. However, in the operation (a) of the second embodiment, it is desirable to prepare a substrate 411, a rear surface 411*a* of which has an MgO film (not shown) since the MgO film emits many secondary electrons that facilitate the plasma discharge.

The operation (b) of the second embodiment unlike the operation (b) of the first embodiment is a step for alternately forming the barrier rib layers 415*a*, 415*b*, 415*c*, and 415*d* and the electrodes 422, 412, and 413 on a front surface 450*a* of the chassis base 450. The method of forming and materials for forming each of the barrier rib layers 415*a*, 415*b*, 415*c*, and 415*d* and the electrodes 422, 412, and 413 are identical to the method and the materials of the first embodiment, but the sequence of stacking the barrier rib layers 415*a*, 415*b*, 415*c*, and 415*d* and the electrodes 422, 412, and 413 are different. That is, in the present embodiment, a first barrier rib layer 415*a* on the chassis base 450, the address electrode 422 is formed on the first barrier rib layer 415*a*, a second barrier rib layer 415*b* is formed on the address electrode 422, the rear discharge electrode 412 is formed on the second barrier rib layer 415*b*, a third barrier rib layer 415*c* is formed on the rear discharge electrode 412, the front discharge electrode 413 is formed on the third barrier rib layer 415*c*, and a fourth barrier rib layer 415*d* is formed on the front discharge electrode 413.

Each of the first barrier rib layer 415*a*, the second barrier rib layer 415*b*, the third barrier rib layer 415*c*, and the fourth barrier rib layer 415*d* can be formed by stacking at least three layers to increase the thickness thereof. Also, the second barrier rib layer 415*b* and the third barrier rib layer 415*c* are requisite for insulating the electrodes but the first barrier rib layer 415*a* and the fourth barrier rib layer 415*d* may not be formed since the first barrier rib layer 415*a* and the fourth barrier rib layer 415*d* are not requisite and are used for securing the discharge space.

In the operation (b), the front discharge electrode 413 formed between the first barrier rib layer 415*a* and the second barrier rib layer 415*b* is extended in a direction, the rear discharge electrode 412 formed between the second barrier rib layer 415*b* and the third barrier rib layer 415*c* is extended parallel to the front discharge electrode 413, and the address electrode 422 formed between the first barrier rib layer 415*a* and the second barrier rib layer 415*b* is extended to cross the front discharge electrode 413. Also, the front discharge electrode 413, the rear discharge electrode 412, and the address electrode 422 are formed to surround the discharge cell 426.

The operation (c) of the second embodiment is a step for forming the fluorescent layer 425 on a front surface 450*a* of the chassis base 450 that defines (or determines the boundaries of) the discharge cells 426 unlike the operation (c) of the first embodiment. The method of forming and the thickness of the fluorescent layer 425 of the preset embodiment are identical to the fluorescent layer 125 of the first embodiment. However, the location is different.

An operation for forming the MgO film 416 on a side surface 415' of the barrier rib 415 can further be included before or after the operation (c). The MgO film 416 can be formed in a thickness of less than 1 μm (microns), such as 0.7 μm. The MgO film 416 prevents the barrier ribs 415 formed of a dielectric from sputtering by positive ions when a plasma discharge occurs and generates many secondary electrons that facilitate the plasma discharge.

When the MgO film 416 is formed by deposition before performing the operation (c), the MgO film 416 can be formed between the fluorescent layer 425 and chassis base 450. When the MgO film 416 is formed by entire deposition after performing the operation (c), the MgO film 416 can be formed on the fluorescent layer 125. In both cases, the MgO film 416 is formed on a front surface 415" of the barrier rib 415. The MgO film 416 formed in either case does not adversely affect the operation of the plasma display module.

The MgO film 416 can be deposited in predetermined pattern before or after the operation (c) by disposing a mask having a predetermined pattern on a front side of the barrier rib 415. The mask can have an arbitrary pattern so that the MgO film 416 can be formed only on a side surface 415' of the barrier rib 415.

Elements that are not described in the second embodiment are identical to the elements of the first embodiment.

Figure 28:
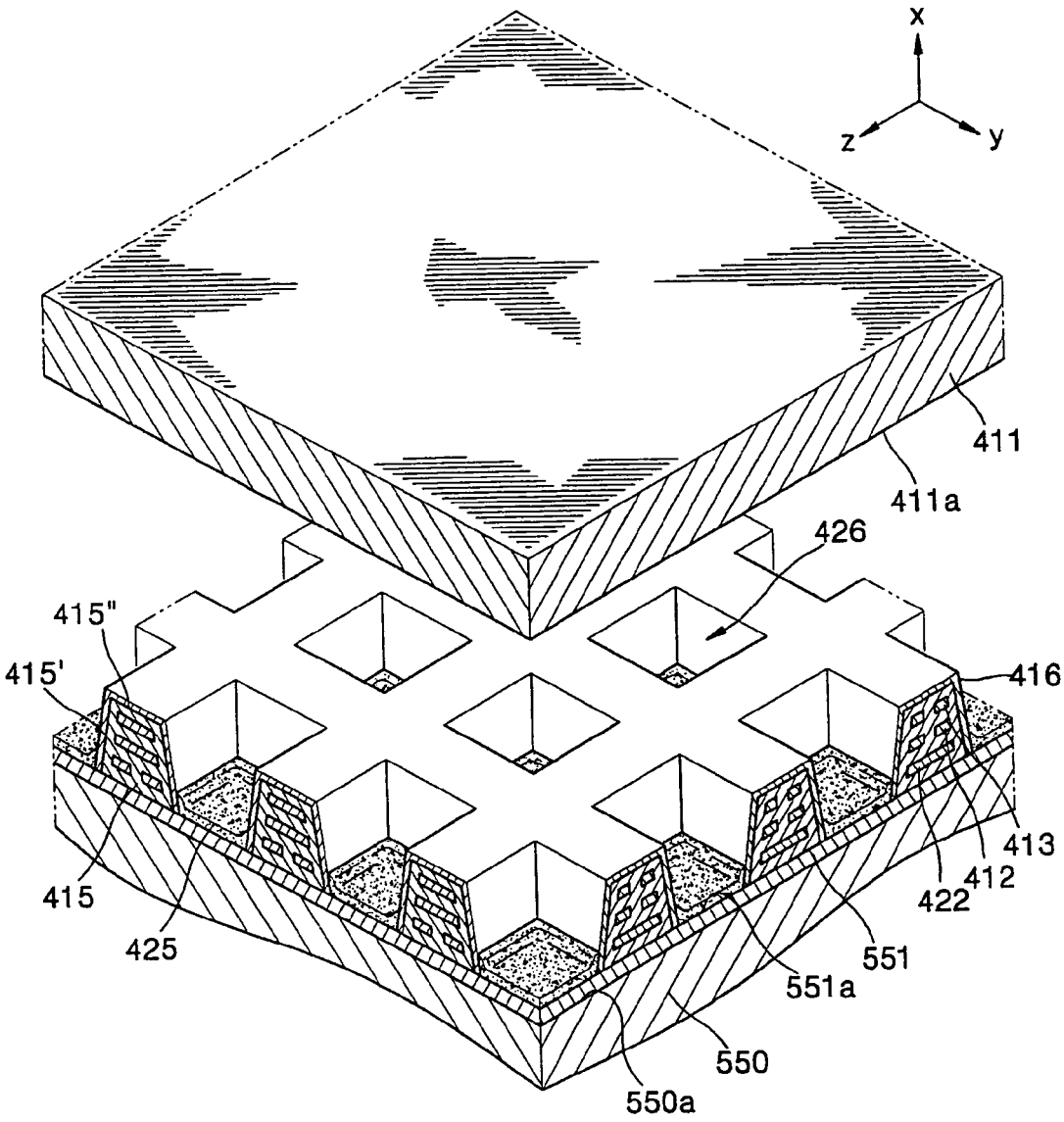
FIG. 28 is an exploded perspective view of a display region of the plasma display module according to a first modified version of the second embodiment of the present invention.

A first modified version of the second embodiment with respect to mainly the differences from the first embodiment will now be described with reference to FIG. 28. The different point of the present modified version from the second embodiment is that a chassis base 550 is formed of a conductive material and an insulating layer 551 is formed on a front surface 550*a* of the chassis base 550.

A lot of heat is generated in the discharge cell when a plasma discharge occurs. However, if the chassis base 550 is formed of a non-conductive material, such as plastic, as in the second embodiment, the heat generated locally in the display region AD cannot be easily dissipated to other elements. In this case, a latent image may be generated on the portion on which heat is accumulated, thereby degrading the image quality. Also, after hours of operation of the plasma display module, the image quality of the whole display region AD may be degraded.

In the present modified version, the chassis base 550 is formed of a conductive material, such as Al, since the conductive material has a greater thermal conductivity than the insulator. However, an insulating layer 551 can be formed on a front surface 550*a* of the chassis base 550 since serious problems with the plasma discharge could arise if the conductive material is exposed to the discharge cell 426. The barrier ribs 415 and the fluorescent layer 425 are formed on a front surface 551*a* of the insulating layer 551.

Furthermore, the front surface 551*a* of the insulating layer 551 is preferably covered by an MgO film (not shown) since the MgO film emits many secondary electrons that facilitate the plasma discharge.

The method of manufacturing the plasma display module according to the present modified version is identical or similar to the method of manufacturing the plasma display module described in the first embodiment. However, the present modified embodiment is different from the second embodiment in that, in the operation (a), the chassis base 550 formed of a conductive material must be prepared and the insulating layer 551 is formed on a front surface of the chassis base 550.

Elements that are not described in the first modified version of the second embodiment are identical to the elements of the second embodiment.

Figure 29:
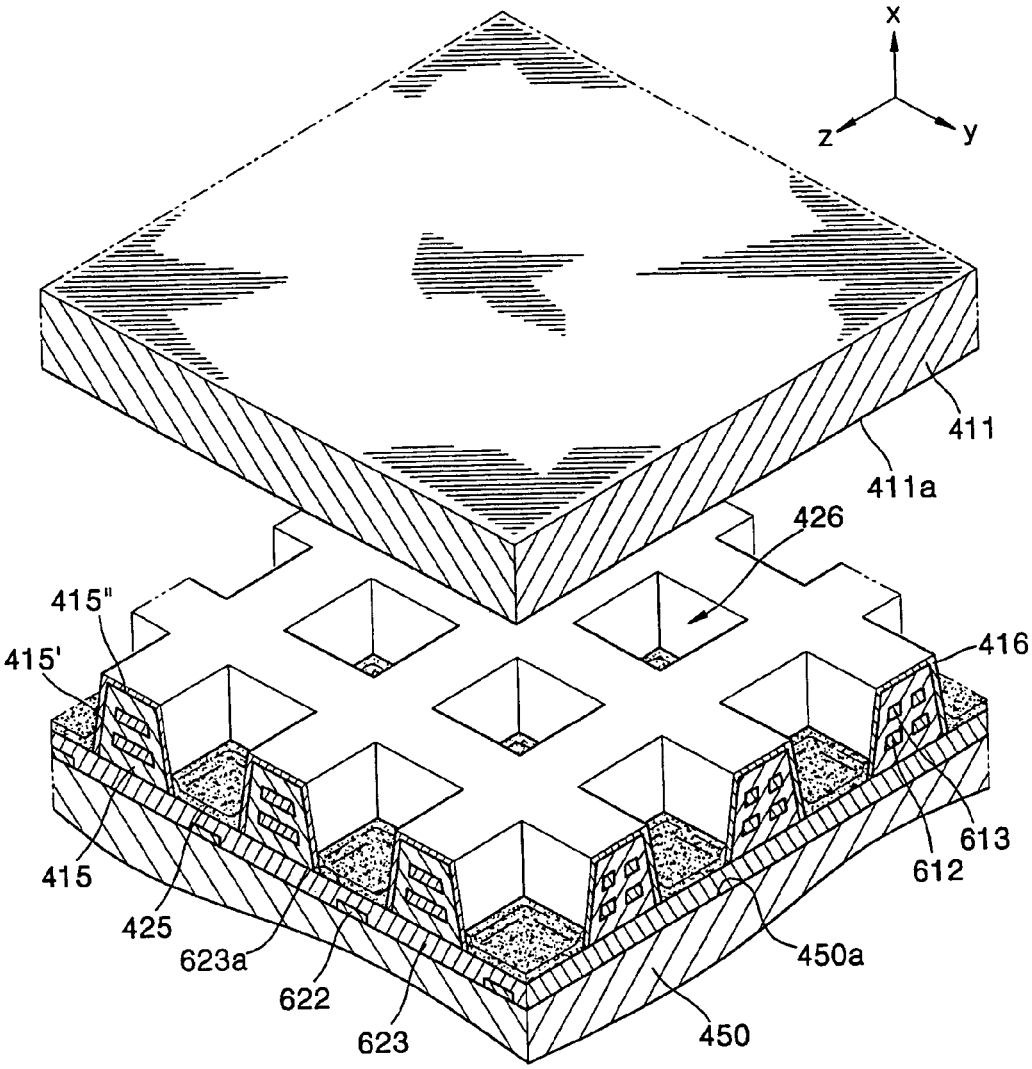
FIG. 29 is an exploded perspective view of a display region of the plasma display module according to a second modified version of the second embodiment of the present invention.

A second modified version of the second embodiment with respect to mainly the difference from the second embodiment will now be described with reference to FIG. 29. The difference of the present second modified embodiment from the second embodiment is that address electrodes 622 are formed on an upper surface 450*a* of the chassis base 450.

The address electrodes 622 are extended to cross front discharge electrodes 613 and rear discharge electrodes 612 extended in a direction, and are covered by a dielectric layer 623. The barrier ribs 415 and the fluorescent layer 425 are formed on a front surface 623*a* of the dielectric layer 623.

The plasma display module according to the present second modified embodiment of the second embodiment is manufactured in the following method. The method includes: (a) preparing a substrate 411 formed of a transparent insulator and a chassis base 450 formed of an insulator; (b) forming address electrodes 622 on a front surface 450*a* of the chassis base 450; (c) forming a dielectric layer 623 covering the address electrodes 622; (d) alternately forming the barrier rib layers and electrodes on a front surface 623*a* of the dielectric layer 623; (e) forming the fluorescent layer 425 on a front surface 623*a* of the dielectric layer 623 in the discharge cells 426 defined by barrier ribs 415 formed on the barrier rib layers; (f) filling a discharge gas in a space formed by coupling the substrate 411 and the chassis base 450 after sealing the space.

The operation (a) of the present modified embodiment is identical to the operation (a) of the second embodiment, the operation (b) is different from the second embodiment in that the sequence of forming the address electrodes is different, the dielectric layer in the operation (c) is formed by a method at least similar to the method of forming the barrier rib layer in the second embodiment, the operation (d) of the present modified embodiment is different from the operation (b) of the second embodiment in that an address electrode and one barrier rib layer are not formed in the present modified embodiment, the operation (e) is different from the operation (c) of the second embodiment in that the location of the fluorescent layer 425 is different, and the operation (f) is identical to the operation (d) of the second embodiment.

The second modified version of the second embodiment can be combined with the first modified version of the second embodiment. In this case, the chassis base 450 is formed of a conductive material and an insulating layer is formed on a front surface 450*a* of the chassis base 450. The barrier ribs 415 and the fluorescent layer 425 are formed on a front surface of the insulating layer.

Elements that are not described in the second modified version of the second embodiment are identical to the elements of the second embodiment.

Figure 30:
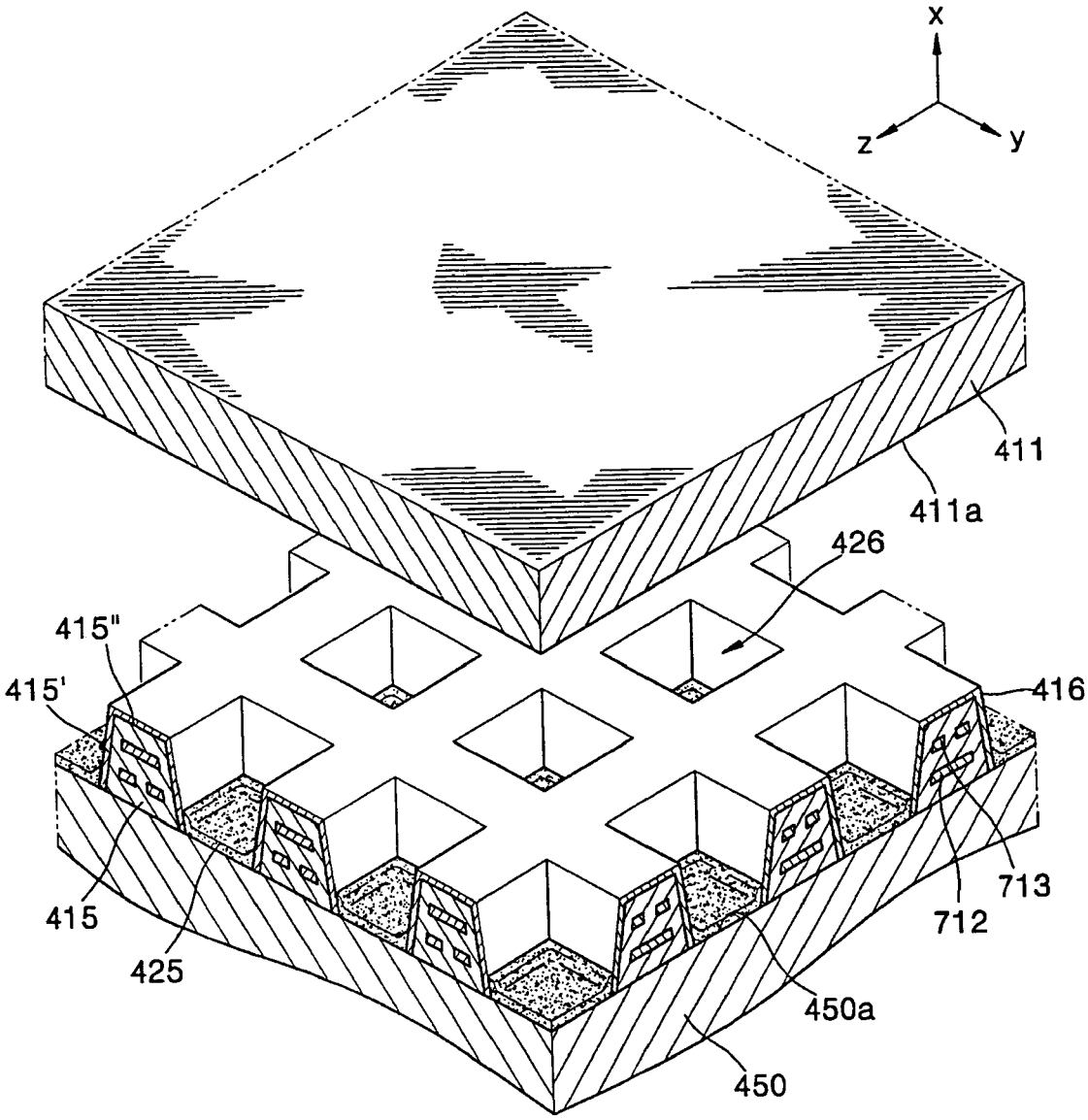
FIG. 30 is an exploded perspective view of a display region of the plasma display module according to a third modified version of the second embodiment of the present invention.

A third modified version of the second embodiment with respect to mainly the differences from the second embodiment will now be described with reference to FIG. 30. The difference of the present modified version from the second embodiment is that the present modified version does not have the address electrodes 422.

Only two discharge electrodes can generate a discharge in a specific discharge cell 426. Therefore, the address electrodes 422 are not a requisite for generating a discharge in the discharge cell 426. However, if there is no address electrode, front discharge electrodes 713 and rear discharge electrodes 712 are extended to cross each other, so that a discharge cell 726, in which the discharge occurs, can be selected. The structure of the electrodes is shown in FIG. 22.

In the present third modified version, only three barrier rib layers are required to dispose the electrodes between the barrier rib layers since there is no address electrode, and only one barrier rib layer can work in the foremost and rearmost discharge cells since the foremost and the rearmost barrier rib layers are unnecessary. In this case, the one barrier rib layer is disposed between the front discharge electrode 713 and the rear discharge electrode 712.

The description of a method of manufacturing the plasma display module according to the second modified version of the second embodiment will be omitted since the method is similar to the method of manufacturing the plasma display module according to the second embodiment.

The third modified version of the second embodiment can be combined with the first modified version of the second embodiment.

Elements that are not described in the third embodiment of the second embodiment are identical to the elements of the second embodiment.

The present invention provides a plasma display module that can improve the emission efficiency of light.

The present invention also provides a plasma display module that can generate a discharge quickly and reduce an address voltage.

The present invention also provides a plasma display module that can be manufactured at lower costs and failure rates. In particular, a rear substrate, which is requisite for a conventional PDP, is not included in the plasma display module according to the present invention, thereby reducing manufacturing cost.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display module, comprising:

a front substrate formed of a transparent insulator;

a chassis base disposed on a rear side of said front substrate;

a plurality of barrier ribs formed of a dielectric disposed between said front substrate and said chassis base, and said plurality of barrier ribs define discharge cells together with said front substrate and said chassis base;

a plurality of front discharge electrodes formed in said barrier ribs that surround said discharge cells;

a plurality of rear discharge electrodes spaced apart from said front discharge electrodes and formed in said barrier ribs to surround said discharge cells;

a fluorescent layer disposed in said discharge cells;

a discharge gas filled in said discharge cells; and a plurality of circuit substrates that apply electrical signals to said front discharge electrodes and said rear discharge electrodes by being disposed directly on a rear surface of said chassis base, and spaced-apart from said front substrate by said chassis base.

2. The plasma display module of claim 1, wherein said barrier ribs are formed on a rear surface of said front substrate.

3. The plasma display module of claim 2, wherein said chassis base is formed of an insulator.

4. The plasma display module of claim 3, wherein a front surface of said chassis base is covered by an MgO film.

5. The plasma display module of claim 2, wherein said chassis base is formed of a conductive material and an insulating layer is formed directly on a front surface of said chassis base.

6. The plasma display module of claim 5, wherein said front surface of said insulating layer formed on the front surface of said chassis base is covered by an MgO film.

7. The plasma display module of claim 2, wherein said fluorescent layer is formed on a rear surface of said front substrate that defines said discharge cells.

8. The plasma display module of claim 7, wherein the thickness of said fluorescent layer is less than 15 μm.

9. The plasma display module of claim 1, wherein said chassis base is formed of an insulator, said barrier ribs are formed on a front surface of said chassis base, and said fluorescent layer is formed on a front surface of said chassis base that defines said discharge cells.

10. The plasma display module of claim 9, wherein a rear surface of said front substrate is covered by an MgO film.

11. The plasma display module of claim 9, wherein the thickness of said fluorescent layer is less than 15 μm.

12. The plasma display module of claim 1, wherein said chassis base is formed of a conductive material, an insulating layer is formed on a front surface of said chassis base, said barrier ribs are formed on a front surface of said insulating layer, and said fluorescent layer is formed on a front surface of said insulating layer formed on the front surface of said chassis base in said discharge cells.

13. The plasma display module of claim 12, wherein said rear surface of said front substrate is covered by an MgO film.

14. The plasma display module of claim 12, wherein said thickness of said fluorescent layer is less than 15 μm.

15. The plasma display module of claim 1, wherein said front discharge electrodes and said rear discharge electrodes are extended in a direction, said chassis base is formed of an insulator, address electrodes extending to cross said front discharge electrodes and said rear discharge electrodes are formed within said barrier ribs, said barrier ribs are formed on a front surface of said dielectric layer, and said fluorescent layer is formed on a front surface of said dielectric layer in said discharge cells.

16. The plasma display module of claim 15, wherein said rear surface of said front substrate is covered by an MgO film.

17. The plasma display module of claim 15, wherein said thickness of said fluorescent layer is less than 15 μm.

18. The plasma display module of claim 1, wherein said front discharge electrodes and said rear discharge electrodes are extended in a direction, said chassis base is formed of a conductive material, an insulating layer is formed on a front surface of said chassis base, address electrodes extending to cross said front discharge electrodes and said rear discharge electrodes are formed within said barrier ribs, said barrier ribs are formed on a front surface of said dielectric layer, and said fluorescent layer is formed on a front surface of said dielectric layer in said discharge cells.

19. The plasma display module of claim 18, wherein said rear surface of said front substrate is covered by an MgO film.

20. The plasma display module of claim 18, wherein said thickness of said fluorescent layer is less than 15 μm.

21. The plasma display module of claim 1, wherein said front discharge electrodes are extended in a direction and said rear discharge electrodes are extended to cross said front discharge electrodes.

22. The plasma display module of claim 21, wherein said front discharge electrodes and said rear discharge electrodes have a trapezoidal shape.

23. The plasma display module of claim 1, wherein said front discharge electrodes and said rear discharge electrodes arc extended in a direction, and further comprising address electrodes disposed in said barrier ribs to surround said discharge cells and extended to cross said front discharge electrodes and said rear discharge electrodes.

24. The plasma display module of claim 23, wherein said front discharge electrodes, said rear discharge electrodes, and said address electrodes have a trapezoidal shape.

25. The plasma display module of claim 23, wherein said address electrodes are disposed in front of said front discharge electrodes.

26. The plasma display module of claim 23, wherein said address electrodes are disposed on a rear side of said rear discharge electrodes.

27. The plasma display module of claim 1, wherein said side surface of said barrier ribs are covered by an MgO film.

28. A plasma display apparatus, comprising:

a front substrate formed of an insulator;

a chassis base disposed on a first side of said front substrate;

a plurality of barrier ribs formed of a dielectric disposed between said front substrate and said chassis base and define discharge cells together with said front substrate and said chassis base;

a plurality of front discharge electrodes formed in said barrier ribs encompassing said discharge cells;

a plurality of rear discharge electrodes spaced apart from said front discharge electrodes and formed in said barrier ribs to encompass said discharge cells; and a plurality of circuit substrates that apply electrical signals to said front discharge electrodes and said rear discharge electrodes, said plurality of circuit substrates being directly disposed on a first surface of said chassis base and spaced-apart from said front substrate by said chassis base.

29. The plasma display apparatus of claim 28, wherein said barrier ribs are formed on a rear surface of said front substrate, said chassis base is formed of a conductive material and an insulating layer is formed directly on a front surface of said chassis base.

30. The plasma display apparatus of claim 28, wherein said chassis base is formed of an insulator.

31. The plasma display apparatus of claim 28, wherein said front discharge electrodes and said rear discharge electrodes are extended in a direction and further comprising address electrodes disposed in said barrier ribs to surround said discharge cells and extended to cross said front discharge electrodes and said rear discharge electrodes.

* * * * *